US010912958B1

(12) United States Patent
Nakash et al.

(10) Patent No.: US 10,912,958 B1
(45) Date of Patent: Feb. 9, 2021

(54) ENHANCED CLAW IN A TACTICAL BREACHING SYSTEM

(71) Applicant: SAN HITEC LTD., Haifa (IL)

(72) Inventors: Ran Nakash, Neot Mordechai (IL); Itam Lachiani, Kiryat Shmona (IL)

(73) Assignee: San Hitec LTD., Haifa (IL)

( * ) Notice: Subject to any disclaimer, the term of this patent is extended or adjusted under 35 U.S.C. 154(b) by 0 days.

(21) Appl. No.: 16/654,044

(22) Filed: Oct. 16, 2019

(51) Int. Cl.
*A62B 3/00* (2006.01)

(52) U.S. Cl.
CPC ..... *A62B 3/005* (2013.01)

(58) Field of Classification Search
CPC ..... A62B 3/005; B66F 15/00; B65G 7/00–12
USPC ..... 254/93 R
See application file for complete search history.

(56) References Cited

U.S. PATENT DOCUMENTS 3,081,066 A * 3/1963 Murawski ..... A62B 3/005 254/93 R
4,789,134 A * 12/1988 Tenuto, Jr. ..... A62B 3/005 254/104
5,048,795 A * 9/1991 Vitale ..... A62B 3/005 254/93 R
5,678,293 A * 10/1997 Sturdevant ..... A62B 3/005 29/239
6,311,537 B1 * 11/2001 Vigil ..... A62B 3/005 254/133 R
6,530,559 B1 * 3/2003 Pell ..... E04G 23/08 254/124
8,393,596 B2 * 3/2013 Lindskog ..... B25F 1/00 254/104
8,485,508 B1 * 7/2013 Newman ..... E05B 19/20 254/100
8,899,553 B2 * 12/2014 Hickerson ..... A62B 3/005 254/133 R
10,058,720 B2 * 8/2018 Weinmeister ..... A62B 3/005

* cited by examiner

*Primary Examiner* — Tyrone V Hall, Jr.
*Assistant Examiner* — Thomas Raymond Rodgers
(74) *Attorney, Agent, or Firm* — William Dippert; Laurence Greenberg; Werner Stemer

(57) ABSTRACT

An enhanced claw in a tactical breaching system for breaching a door system having a door and a door frame, the tactical breaching system having a hydraulic cylinder configured to drive a drive piston, the enhanced claw comprising: a stationary static tooth pair mechanically fixed to the hydraulic cylinder, the static tooth pair having top and bottom static tooth surfaces; a dynamic tooth axially attached to the drive piston, the dynamic tooth having top and bottom dynamic surfaces, the dynamic tooth configured to be driven forward and away from the static tooth pair, the static tooth pair and the dynamic tooth initially aligned in a closed configuration, the enhanced claw having a plurality of parameters shared by the static tooth pair and the dynamic tooth, including; a sharply-tapered and curved profile; a relative tooth length parameter; a robustness of the claw to resist torsion; and opposing sets of grooved teeth on the top surface of the static tooth pair and on the bottom surface of the dynamic tooth, respectively.

10 Claims, 17 Drawing Sheets

DETAIL "B"
(b)

(a)

DETAIL "C"
(b)

(a)

DETAIL "D"
(b)

(a)

DETAIL "E"

(b)

SECTION V-V

DETAIL "F" - inverted

SECTION W-W (a)

DETAIL "G"

(b)

ENHANCED CLAW IN A TACTICAL BREACHING SYSTEM

FIELD OF THE INVENTION AND BACKGROUND

The current invention relates to police, fire, paramilitary, and military, and similar special rescue breaching operations, and specifically to an enhanced claw in a tactical breaching system.

The term "breaching", as used, for example in "breaching system", as used in the specification and claims which follow hereinbelow, is intended to mean gaining access to a building or building space or room by forcibly opening a locked door, gate, or similar device intended to block access. The term "room", as used in the specification and claims which follows is intended to include a building, a building space, such as a room and elevator, inter alia or any other space into which breaching is performed to gain entry. Similarly, the term "door" used hereinbelow is intended to mean a door, gate, window, or similar object known in the art, intended to block access to a room. The term "rescuer" as used in the specification and claims which follow hereinbelow is intended to mean one or more personnel who are typically authorized to breach a door, such as but not limited to: police, fire fighters, rescue teams, emergency services, and military and special forces.

Breaching may include the use of explosives, weapon fire, and other incendiary means—and this is commonly referred to as "hot breaching". However, there are disadvantages to hot breaching, as listed hereinbelow:

- It is clearly a most dangerous method to both rescuers and to room occupants.
- Hot breaching usually demands additional setup and preparation work to ensure safety, even in combat situations.
- The resultant time element associated with setup/preparation in hot breaching is not always advantageous to rapidly breach a door.
- In situations, such as, but not limited to covert/surprise entry situations, hot breaching is extremely noisy, destructive and may not be desirable.
- In many civilian frameworks, rescuers do not have authority to apply hot breaching.

"Cold breaching", that is, breaching using solely mechanical and non-pyrotechnical means (i.e. not hot breaching) is in many cases a preferred breaching method, and embodiments of the current invention deal with cold breaching. In the specification and claims which follow hereinbelow, the meaning of the term "breaching" is further narrowed, and it is intended to mean cold breaching, as defined hereinabove.

Reference is currently made to FIGS. 1 and 2, which are isometric representations of a prior art door system 2 having a door 4, a door frame (or simply "frame") 4, and typically two or more door hinges (or simply "hinges) 8. The door of FIG. 1 is shown opening inward (i.e. away from the point of view and having hinges, not visible, on the inward opening side of the door) and the door is called an "inward opening door"; whereas the door shown in FIG. 2 is opening outward (i.e. towards the point of view and having hinges visible on the outward opening side of the door) and the door is called an "outward opening door".

Where no tools are available, it is sometimes possible to force open many inward-opening locked doors with a strong kick, breaking through the door frame. This can be a common method of entry for trained police officers conducting warranted searches or by fire fighters attempting to quickly ingress a room to rescue people, for example. Lighter doors of this type are becoming less common and kicking in a door is usually not possible in the case of a reinforced, heavy, door and/or when the door opens outward and/or when the door may be a sliding door (not shown in the figures). In any/all of these cases, an array of specialized tools are almost always necessary to breach the door.

A number of companies have developed arrays of tools for tactical breaching to address each of the door possibilities, such as but not limited to: inward opening/outward opening doors; heavy doors; soft doors/soft frames; rolling and/or sliding doors; ship doors; doors with no access to the frame; heavy bunker/shelter doors; windows; and shutters.

While a specialized tool may be the best approach for a corresponding specialized breaching application, frequently rescuers must arrive on the scene having no detailed knowledge of the type of door(s) they must breach. Additionally, in most cases, they are frequently tasked with breaching the door(s)/doors as rapidly as possible, meaning that rapid movement and speed of deployment constrain rescuers to carry as few tools as possible. This problem is further exacerbated, for example, in civilian high rise buildings where rescuers must climb a large number of flights (sometimes well over 10 flights) and/or in combat situations, when the rescuer may additional need to carry a weapon and ammunition and/or need to cover large distances—and it is therefore not practical for a rescuer to carry a large array of heavy equipment/tools on his back.

As a result, some companies—including SAN Ltd., the assignee of the current patent application—have developed a tactical breaching system based on a pneumatic/hydraulic cylinder—which has the advantage of being relatively lightweight and applicable to many breaching configurations. The prior art systems typically employ a hydraulic cylinder, housing a drive piston, to which a claw device (referred to as simply "claw", and further defined hereinbelow) is connected. The claw is typically fitted/forced into a gap/space between the door and door frame and the door is breached using hydraulic power. Examples of a pneumatic/hydraulic-cylinder driven breaching mechanisms/systems, dating from about 1985 until about 2005, are as follows:

- Holmatro "Door Opener HDO 100", having a hand pump (additional, heavy equipment) providing hydraulic power. https://www.holmatro.com/en/special-tactics/door-opener-hdo-100-st, Holmatro Group, Lissenveld 30, POB 66, 4940 AB, Raamsdonksveer, Netherlands
- Lukas "HTS-90 Hydraulic Door Opener", also having a hand pump. https://rescue.lukas.com/accessories_cutter_door_opener_hts90.html Lukas Hydraulik GMBH, Weinstrasse 39, D-91058, Erlangen, Germany
- Ogura "Hydraulic Rescue System HRS-936 and 946", having battery powered hydraulic unit, saving weight, very limited tools http://www.ogurarescuetools.com/newhead935.html, Ogura & Co. Ltd., 2661 Hongo, Ebina-City, Kanagawa, 243-0417 Japan
- Libervit "OP53", also having a hand pump. http://www-.libervit.eu/pgs/produits.php?gamme_id=1&id=251&lang=fr, Libervit, Espace Polygone, 218 rue Ettore gugatti, 66000 Perpignan, France
- Hydro-Noa "HN-1675-L Door Breacher", http://hydronoa.com/product/hn-1675-1-2-2/, Hydro-Noa Ltd. 2, Bet-Alfa Str., Tel Aviv 67219, Israel SAN "Door Breaker", longer stroke, lightweight, battery-driven hydraulic pump, https://www.san.co.il/product/door-breaker/, SAN Ltd., 21 Halutzey Hata'aseya St., Haifa 26118, Israel Reference is currently made to FIGS. 3-6, which are representations of cross-sectional views of door system 2 and door 4 and the SAN Ltd. prior art tactical breaching system 10. FIGS. 3 and 6 show an "inward opening door" (as shown in FIG. 1) whereas FIGS. 4 and 5 show an "outward opening door" (as shown in FIG. 2). Apart from differences described below, door system 2 and door 4 of FIGS. 1 and 2 (hereinabove) are identical in notation, configuration, and functionality to that shown in FIGS. 3-6, and elements indicated by the same reference numerals and/or letters are generally identical in configuration, operation, and functionality as described hereinabove.

Prior art breaching system 10 includes: a claw 11, composed of a static tooth pair 12 and a dynamic tooth 14, a hydraulic cylinder 16, system stabilizing handle 18, and drive piston 19. Stabilizing handle 18, attached to hydraulic cylinder 16, is typically grasped to assist in positioning and stabilizing the system as described hereinbelow.

Static tooth pair 12 dynamic tooth 14 are typically formed of a hard and strong metal, preferably steel. Static tooth pair 12 is mechanically fixed to hydraulic cylinder 16 and typically does not move, whereas dynamic tooth 14 attached to the end of drive piston 19 and is driven forward when drive piston is operated, as described further hereinbelow.

Referring to FIGS. 3 and 5, door 4 is breached by inserting (usually with application of force) claw 11 into a gap 13 between the door and the frame. Once the claw is inserted into the gap, the hydraulic cylinder is activated to drive the drive piston, thereby advancing dynamic tooth 14 against the frame (in the case of an outward opening door) or against the door (in the case of an inward opening door), while static tooth pair 12 remains stationary, the door (in the case of an outward opening door) or against the frame (in the case of an inward opening door). FIGS. 4 and 6 show the configuration of the system 10 and door system 2 as the hydraulic cylinder and the drive piston serve to breach the respective doors. It is clearly advantageous to having a system having a longer piston drive (also called "stroke") to address a wider array of door breaching situations.

Limitations in Prior Art Systems

Different door types (i.e. inward and outward opening door) and different door configurations/construction (i.e. heavy frame, heavy door, reinforcements, metal, wood, etc.) may provide challenges for the claw used with the breaching system. In many straightforward cases, breaching the door with prior art breaching system 10 can be accomplished in under 30 seconds and as quickly as 10-20 seconds. However, when difficulties/complications arise—as described hereinbelow—the time to breach the door can extend from 4-5 minutes to as much as 10 minutes, which is critical in many rescue life-or-death situations.

Radial/Linear Considerations

As is seen in FIGS. 4 and 6, drive piston 19 operates in a linear/straight direction, while door 4 exhibits a certain radius (about the hinges) as the door is breached. The direction mismatch (linear-versus-radial) can typically cause system 10 to slip/fail during breaching and further complicate and delay breaching efforts as the system is repositioned, as known in the art. Additionally, in certain slippage/retry configurations, the door and/or frame are damaged by a first attempt to grasp the door/frame and the damage sometimes obviates an attempt to reposition the system as shown in the figures. It is therefore important, whenever possible, that initial positioning of the claw afford the best possible grasp of the door/frame.

Claw Teeth vs. Door Configuration

In FIG. 3, the claw is typically forced into the gap in a relatively straightforward manner, meaning system 10 is maintained nearly perpendicularly relative to the door and the dynamic tooth is driven against a relatively large and stable door surface. In many cases the frame, against which the static tooth pair anchors against, is stable and strong and allows the hydraulic force of the piston to effectively drive the dynamic tooth—as shown in FIG. 6. However, there are cases when the frame may be weak and/or constructed of weak materials—and the frame may fail or crumble at a contact point with the static tooth pair. This may force repositioning of system 10 (refer again to FIG. 3) and additional time and effort may be needed to breach the door.

Similarly, in the door system configuration shown in FIG. 5, outward opening and having a reinforced/recessed door-frame configuration, it is difficult to position the claw to obtain a "grasp" of the gap between the door and the frame. In many cases, the length of the claw (i.e. the distance the claw can be inserted into the gap) limits the ability to grasp the gap. On the other hand, a claw having elongated fingers could break while positioning and activating the system. It is therefore clear that a strong and stable grasp of the gap by the system is essential for successful breaching, especially in difficult door systems.

Alignment of Piston with Claw Placement

Referring to FIGS. 5 and 6, after the claw is position and the system is activated and the dynamic tooth moves away from the static tooth pair, the extended piston is subject to an increasing torsion force—especially present with a longer piston stroke, such as that of the prior art SAN system. Initial positioning of the claw is critical to avoid and/or lessen the chance of piston failure due to the large hydraulic force and the separation of the two teeth.

Claw Construction and Teeth

Reference is currently made to FIGS. 7A and 7B, which are an isometric view and a cross-sectional view of the prior art static tooth pair shown in FIGS. 3-6. Apart from differences described below, static tooth pair 12 of FIGS. 3-6 (hereinabove) are identical in notation, configuration, and functionality to that shown in FIGS. 7A-B, and elements indicated by the same reference numerals and/or letters are generally identical in configuration, operation, and functionality as described hereinabove. Additionally, the centerline axis of the hydraulic cylinder—ref to FIGS. 3-6—(to which the static tooth pair is connected) is shown and further discussed hereinbelow, It is noted that because static tooth pair 12 and dynamic tooth 14 (refer to FIGS. 3-6) are typically initially aligned with each other to form the claw, the following discussion of FIGS. 7A and 7B regarding the static tooth pair applies to the overall shape and dimensions of the entire claw. Prior art static tooth pair 12 includes two individual teeth 20, with each individual tooth having a flat base 22 and typically a group of 5 grooved-teeth 24 aligned in a straight sloping pattern as shown in the figure. A flat leading edge 26 of the claw is defined at the intersection of flat base 22 and grooved-teeth 24.

The following is a discussion defining parameters, to evaluate static tooth pair dimensions and characteristics.

A "slope", a/b, of the grooved-teeth 24 is defined by the dimensions "a" and "b" indicated in the figure. Exemplary values for "a" and "b" are, approximately 20 mm and 50 mm, respectively. Therefore, the slope is approximately 0.4, representative of the value of some prior art claws/teeth.

A "neck" as indicated by $N_1$ also typifies prior art claws. A "relative neck width", giving an indication of the robustness/strength of the tooth against torsion, is defined in the expression "$N_1/b$". Using the exemplary values of $N_1$=10 mm and b=50, the relative neck width ($N_1/b$) is approximately 0.2, typical of the relatively narrow neck of prior art claws/teeth.

A "relative tooth length", giving an indication of the tooth geometry allowing entry into a tight gap, is defined by the distance from the centerline of the hydraulic cylinder to the edge of the tooth, indicated by "c" in the referenced figure, divided by "b".

A "grooves per mm" value, yielding a measure of the surface area of the tooth to grasp the door/frame, is defined by the number of grooves per running mm of tooth. In the prior art, this is 5/23, or 0.22 grooves/mm, again typical of the prior art.

The parameters noted hereinabove and the overall structure of prior art claws serve to focus on shortcomings of the straight, rather blunt and truncated configuration of the prior art claw and to emphasize at least four problems:

1. Initial insertion/penetration of the gap is limited by the blunt prior art claw configuration (specifically, the slope and the relative neck width);
2. Because insertion is partial—at the end of the prior art claw—and/or the claw (and its teeth) has/have a flat configuration with a narrow neck, the claw is subject to strong torsion and to possible mechanical failure;
3. During breaching, slippage of the prior art claw is common due to the configuration (including shape and grooves per mm) of the grooved teeth; and
4. Prior art claws have straight/flat edges, including flat base 22 and flat leading edge 26 (ref FIGS. 7A and 7B). Such flat edges can make initial and subsequent positioning and manipulation of the claw difficult, such as, but not limited to having to work tightly against the door and/or frame, as described hereinabove.

Related to point 4 above, the prior art claw construction and tooth configuration of the prior art further contribute to problems related to repositioning/withdrawing the claw and/or the need for additional tools, as follows:

Repositioning/Withdrawing Claw

In certain door system configurations, such as that shown in FIG. 5, the breaching system is initially aligned nearly parallel to the door, the prior art claw is inserted, and the piston is momentarily activated. The initial alignment and momentary activation of the breaching system places a force on the door, called "crushing", operating mostly in the direction of the door hinges. (This is done to prepare the door for a different, more favorable orientation of the breaching system and claw in relation to the gap to allow more effective breaching.) After the momentary crushing, the prior art claw must be withdrawn and subsequently repositioned. The flat configuration of the prior art claw makes it difficult/cumbersome to withdraw the claw from the initial position.

Additional Tools Necessary

Many prior art breaching systems similar to the systems discussed hereabove nonetheless require additional tools to be used (such as, but not limited to crowbars and other devices) because of the claw limitations mentioned hereinabove. In fact, in nearly all breaching scenarios using any of the prior art systems noted hereinabove, a crowbar is frequently used to initially open the gap between the door and the frame. Clearly, a claw that can address a wider array of breaching possibilities without the need for additional tools is preferable.

There is therefore a need for a tactical breaching system having an enhanced claw that can be used nearly-exclusively to effectively and quickly address an array of breaching possibilities without the need for additional tools, thereby allowing rescuers greater ease of deployment and speed by carrying as few tools as possible, inter alia.

SUMMARY OF INVENTION

According to the teachings of the current invention, there is provided an enhanced claw in a tactical breaching system for breaching a door system, the door system having a door, a door frame, and hinges, the tactical breaching system having a hydraulic cylinder configured to drive a drive piston, the enhanced claw comprising: a stationary static tooth pair mechanically, axially, fixed to the hydraulic cylinder, the static tooth pair having a top and a bottom static tooth surface; a dynamic tooth axially attached to the drive piston, the dynamic tooth having a top and a bottom dynamic tooth surface, the dynamic tooth configured to be driven forward and away from the static tooth pair, assuming an open configuration when the drive piston is operated; the static tooth pair and the dynamic tooth initially aligned in a closed configuration, the enhanced claw having a plurality of characteristics and parameters shared by the static tooth pair and the dynamic tooth, including; a sharply-tapered and curved profile characterized by a slope parameter having a value less than 0.25 and a relative tooth length parameter having a value of at least 1.0; a robustness of the claw to resist torsion, characterized by a relative neck width parameter having a value of at least 0.4; and opposing sets of parallelly-grooved teeth, on the top static tooth surface and on the bottom dynamic tooth surface, respectively, characterized by a grooves/mm parameter having a value of at least 0.75 grooves/mm; wherein the enhanced claw is forced into a gap between the door and door frame to address an array of breaching configurations without the need for additional tools, the tactical breaching system being an enhanced tactical breaching system. Preferably, the set of plurality of characteristics and parameters further comprises two curved shapes, including: a curved leading base surface, which is a curved extension of a flat base of the bottom dynamic tooth surface and of the bottom static tooth surface; and a curved leading lip, which is a curved extension of the surface defined by the grooved-teeth of the top dynamic tooth surface, the two curved shapes characterized by a first radius and a second radius, respectively. Most preferably, the static tooth pair and the dynamic tooth each have: the flat base characterized by a length dimension, "B"; a vertical axis, coaxial to the drive piston and to the static tooth pair and a tooth pair circular socket having an outer diameter dimension "C"; a tooth length "H", measured perpendicularly from the vertical axis to the edge of the curved leading base surface; a first radius center point, measured parallel to B and perpendicularly to the vertical axis, having a horizontal dimension equal to E plus C/2 and having a vertical dimension of G, measured perpendicularly from the flat base of the tooth pair; and a second radius center point, measured parallel to B and perpendicularly to the vertical axis, having a horizontal dimension equal to D plus C/2 and having a vertical dimension of F, measured perpendicularly from the flat base of the tooth pair.

Typically, the static tooth pair has two necks, representing thickened ribs of each tooth of the tooth pair, each neck having a characteristic value $N_2$, measured parallel to B. Most typically, the grooved teeth on the top surface of the static tooth pair static are configured according to the slope parameter, the slope parameter equal to F/B. Preferably, the relative neck width is equal to $N_2$/B, and the relative tooth length equal to B/H. Most preferably, B is approximately 98 mm, C is approximately 64 mm, D is approximately 51 mm, F is approximately 21 mm, and $N_2$ is approximately 43 mm Typically, the first radius and the second radius are approximately 48.4 and 18.1 mm, respectively. Preferably, the static tooth pair and the dynamic tooth are formed of hardened alloyed steel.

According to the teachings of the current invention, there is further provided a method of using the enhanced claw of claim 1 to breach the door, the method including the steps of: [a] sliding the enhanced claw, in a closed configuration, into a gap, using the initial sharply-tapered and curved profile of the static tooth pair and the dynamic tooth; [b] using a rocking motion to further penetrate the enhanced claw into the gap; [c] opening and widening the gap by alternately opening and closing the enhanced claw by operating the hydraulic cylinder and the drive piston to more substantially penetrate the enhanced claw into and to further open the gap, taking advantage of the opposing sets of grooved teeth of the static tooth pair and dynamic tooth and of the curved profile of the enhanced claw to better insert and lock the enhanced claw between the door and the frame; [d] more fully operating the drive piston to further open the enhanced claw and thereby further breach the door, once step "c" is completed and the enhanced claw is more substantially penetrated into the gap and locked into position; and [e] during breaching, momentarily and partially retracting the piston to remove and reposition the enhanced claw, as necessary, and returning to step "d", as necessary. Preferably, the array of breaching configurations is addressed without the need for a crowbar and additional tools. Most preferably, the curved profile of the static tooth pair and the dynamic tooth enable the drive piston to apply force to breach the door in an optimal, linear configuration while doing so according to the radial opening of the door.

Typically, in the end of step c and in step d, the enhanced claw forms a deformation of the door, whereby a rocking motion is used to further penetrate the enhanced claw into the gap and to the inside surface of the door, thereby better seating the enhanced claw against the door and to significantly shorten the time to breach the door and avoid complications during breaching.

LIST OF FIGURES

The invention is herein described, by way of example only, with reference to the accompanying drawings, wherein.

DETAILED DESCRIPTION

Embodiments of the current invention relate to police, fire, paramilitary, and military, and similar special rescue breaching operations, and specifically to an enhanced claw in a tactical breaching system.

Reference is currently made to FIGS. 8A-8D, which are isometric representations of an enhanced tactical breaching system 110, in accordance with embodiments of the current invention.

Figure 8A:
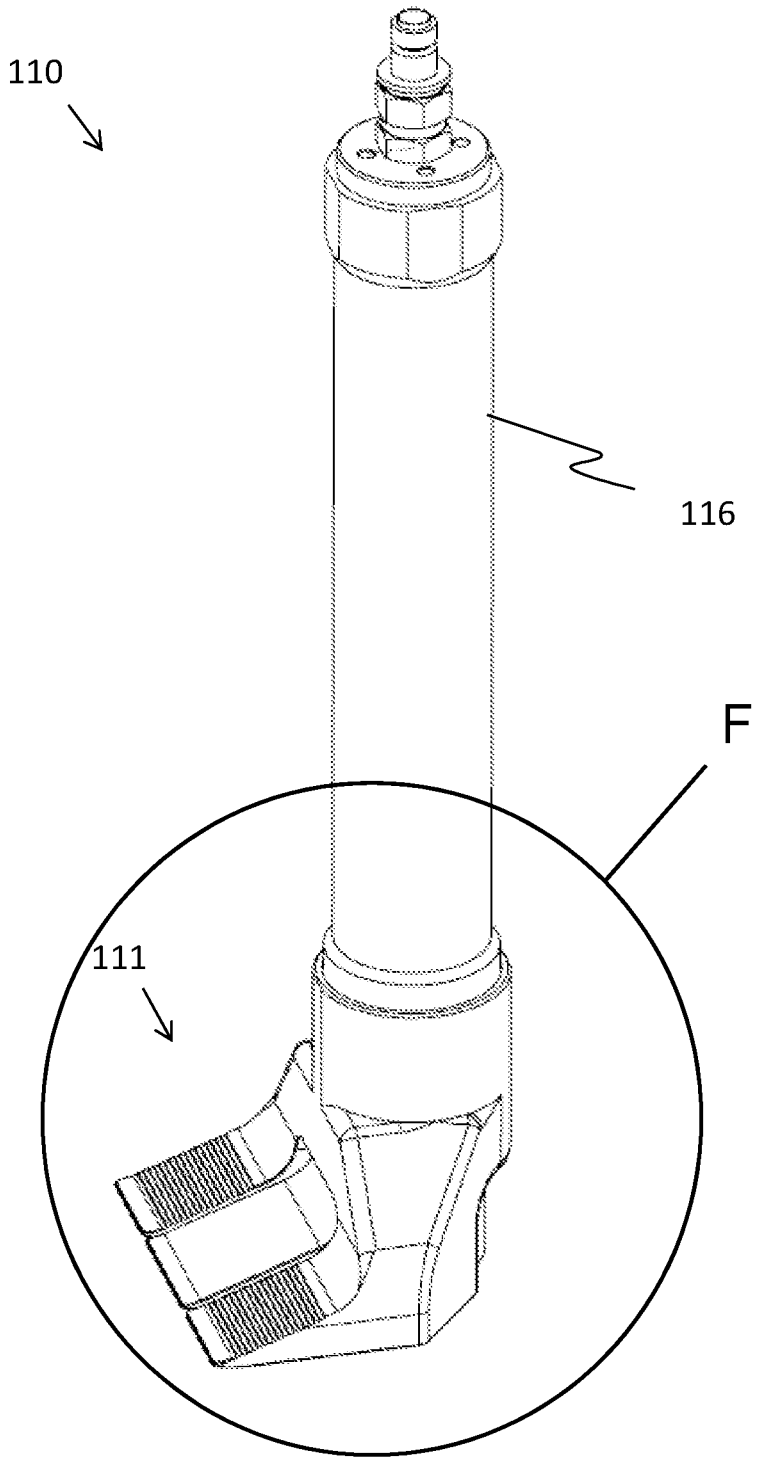
FIGS. 8A-8D are isometric representations of an enhanced tactical breaching system having an enhanced claw, in accordance with embodiments of the current invention.
Figure 8B:
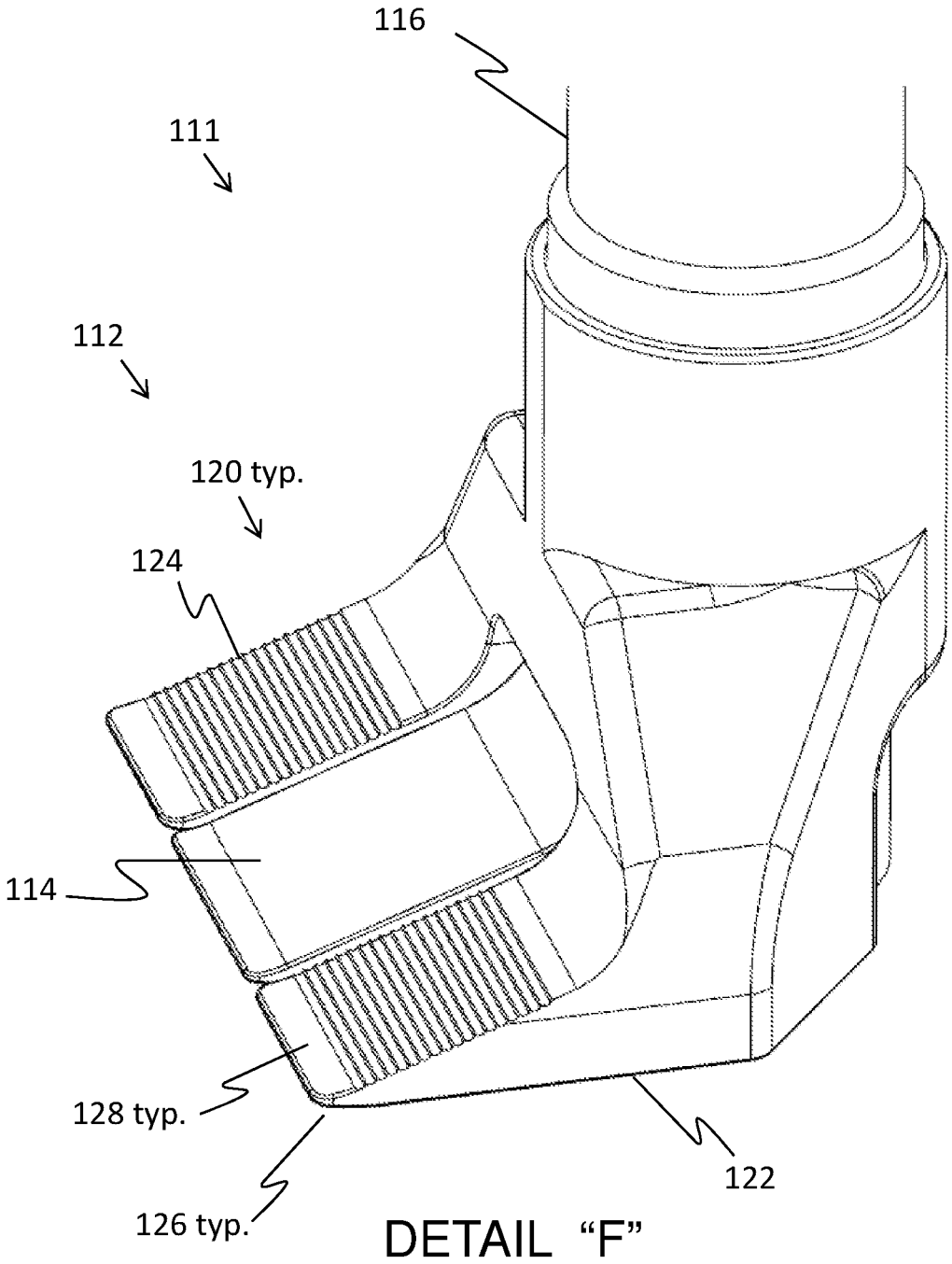
Figure 8C:
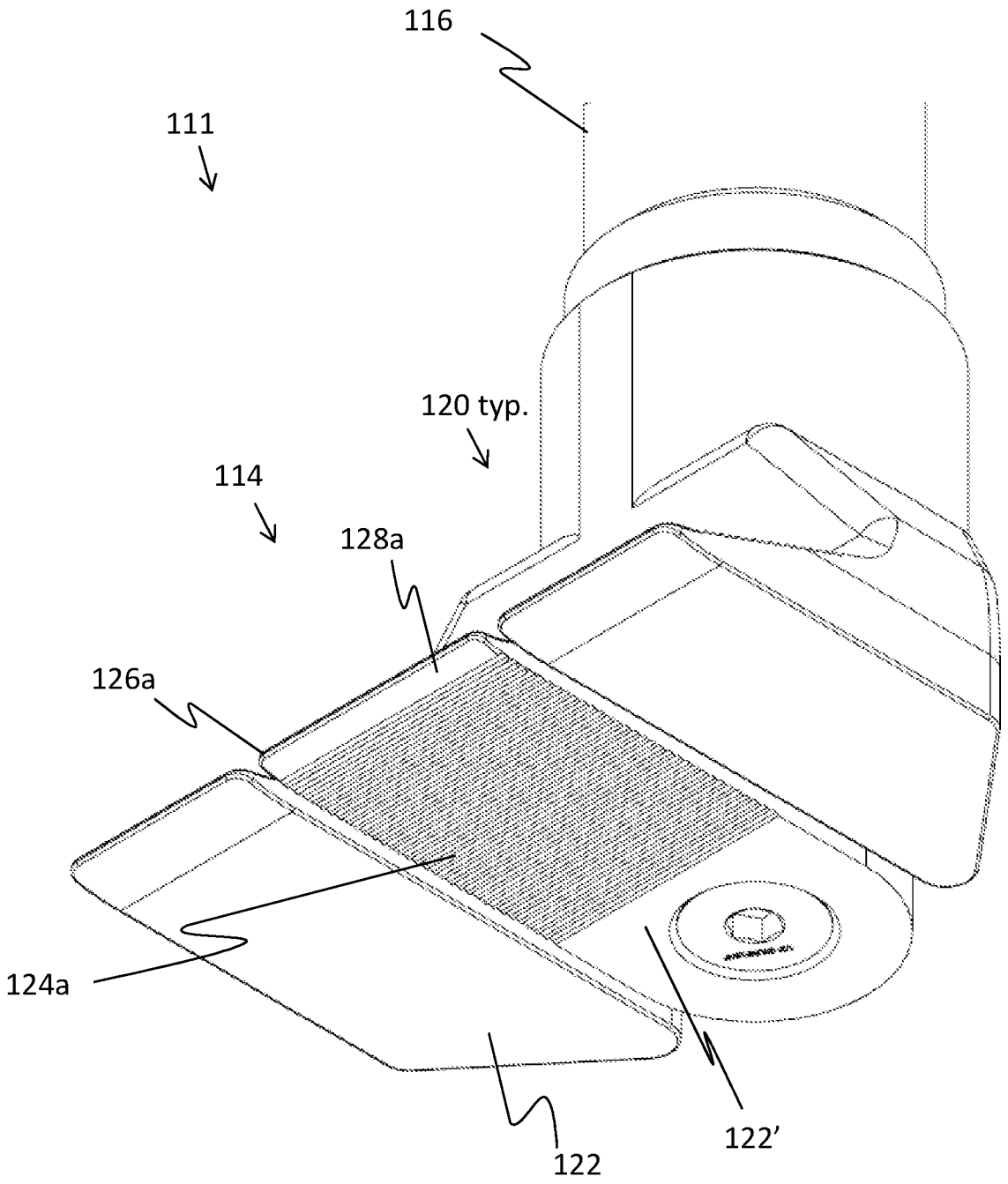
Figure 8D:
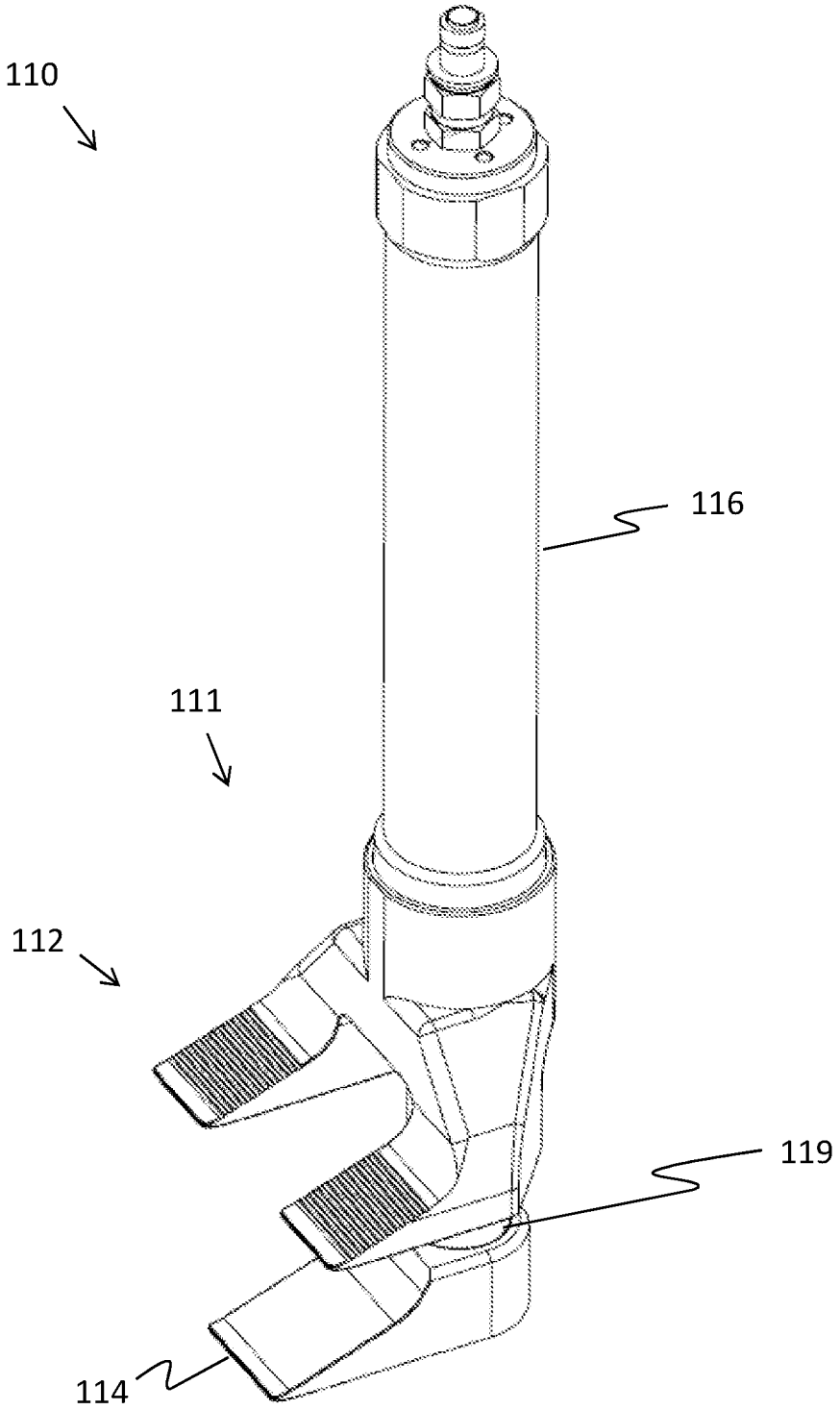

Enhanced tactical breaching system 110 includes: an enhanced claw 111, composed of a static tooth pair 112 and a dynamic tooth 114, a hydraulic cylinder 116, and a drive piston 119. (System 110 may further include a system stabilizing handle—not shown in the current figure—similar to that shown in FIGS. 3-6.) Static tooth pair 112 and dynamic tooth 114 are typically formed of a hard and strong metal, preferably hardened steel of various alloys know in the art. Static tooth pair 112 is mechanically fixed to hydraulic cylinder 116 and the static tooth pair typically does not move; whereas dynamic tooth 114 is attached to the end of drive piston 119 and is driven forward, i.e. away from static tooth pair 112, when the drive piston is operated, as shown in FIG. 8D. In FIGS. 8B and 8C, dynamic tooth 114 is shown substantially aligned with static tooth pair 112 and the enhanced claw is in a "closed configuration". FIGS. 8A, 8B and 8D show the enhanced claw from above (i.e. "top view"), whereas FIG. 8C shows the claw from an inverted or bottom view (i.e. from below).

Enhanced tactical breaching system 110 and enhanced claw 111 are applied to breaching situations such as, but not limited to, those shown in FIGS. 3-6—and as further described hereinbelow. It is noted that because static tooth pair 112 and dynamic tooth 114 are initially in a closed configuration to form the enhanced claw, the following discussion and that of FIGS. 9A and 9B hereinbelow regarding the shape of static tooth pair 112 applies to the overall shape and dimensions of the entire claw.

Static tooth pair 112 includes two individual teeth 120, with each individual tooth 120 having a flat base 122 and typically having a group of over 15 parallelly-grooved-teeth 124 configured in a pattern as shown in the figure. (More details about the configuration of group of over 15-grooved-teeth are described further hereinbelow.) Individual tooth 120 further has a slightly-rounded leading lip 128 defining the edge of tooth 120 and adjoining grooved-teeth 124, as shown in the figure. Leading lip 128 has a rounded contour 126 defining two exterior corners of leading lip 128, as shown in the figure and as further described hereinbelow.

Referring to FIG. 8C, showing a view from the bottom/inverted side of enhanced claw 111, dynamic tooth 114 includes: a flat base 122' (similar to flat base 122 of individual tooth 120) having a plurality of parallelly-grooved teeth 124' aligned in a pattern as shown in the figure (similar to grooved teeth 124 of individual tooth 120); and a leading lip 128*a* (similar to leading lip 128 of individual tooth 120). Flat base 122', plurality of grooved teeth 124*a*, and leading lip 128*a* are all configured on the side of dynamic tooth 114 opposing that of similar shape and features of static tooth pair 112. Leading lip 128*a* has a rounded contour 126*a* defining two exterior corners of leading lip 128, as shown in the figure and as further described hereinbelow.

As noted hereinabove, static tooth pair 112 and dynamic tooth 114 are initially in a closed configuration. As shown in FIG. 8C, when in the closed configuration, the plurality of parallelly-grooved teeth of dynamic tooth 114 do not extend past flat base 122. However, when drive piston 119 is activated (ref FIG. 8D) and dynamic tooth 114 is separated (i.e. advanced) from the static tooth pair, the plurality of parallelly-grooved teeth of dynamic tooth 114 are presented/extended on the bottom side of the claw, in opposition to the group of parallelly-grooved-teeth of the two individual teeth of static tooth pair 112. Enhanced claw 111, having a closed configuration, presents an initial sharply-tapered and curved profile, with only the top side of the claw (i.e. the static tooth pair) initially presenting grooved teeth. The opposing configuration of dynamic tooth 114 to static tooth pair 112 and the initial sharply-tapered and curved profile of the enhanced claw are advantageous in different breaching situations and are described further hereinbelow.

Figure 9A:
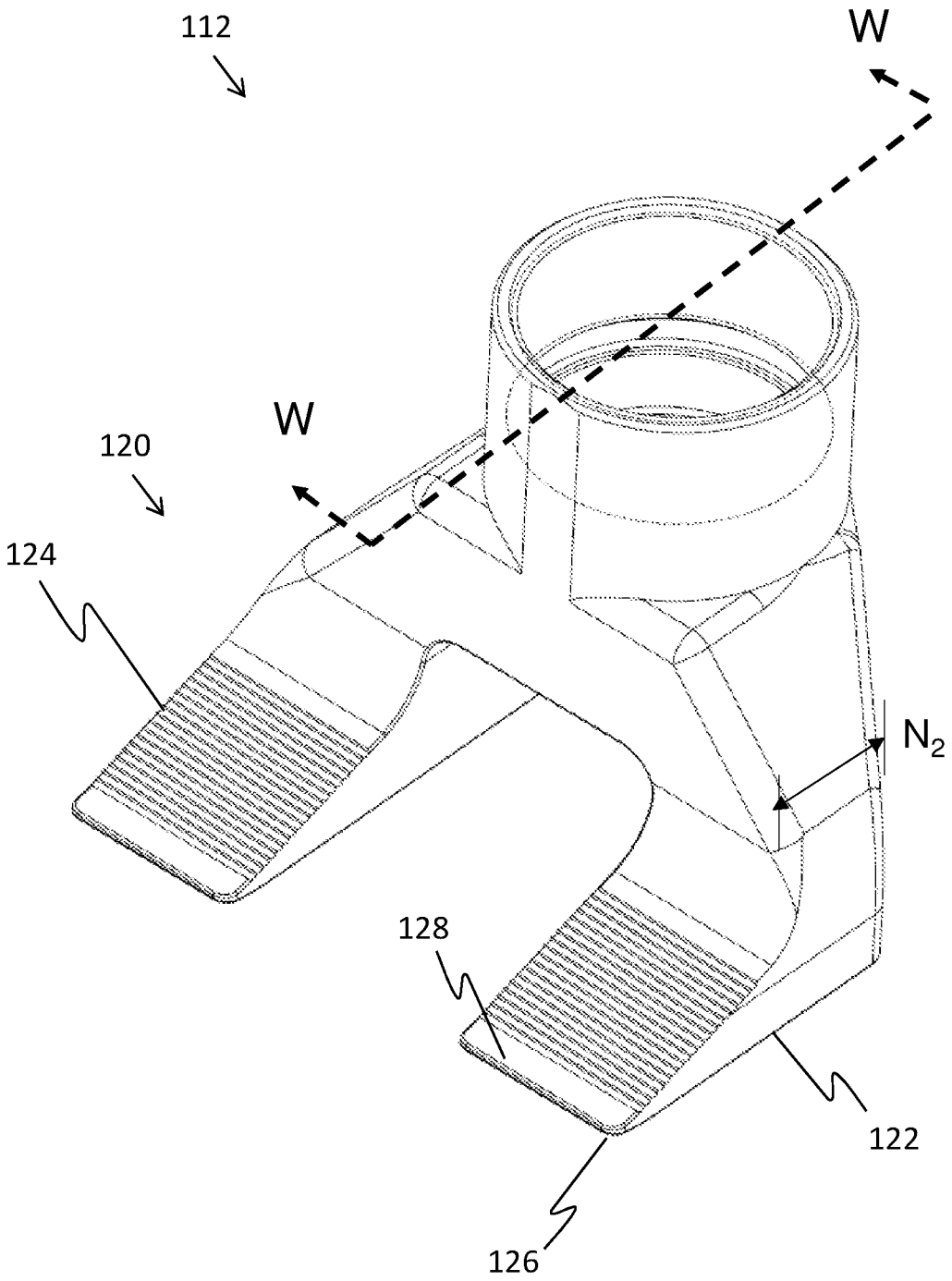
FIGS. 9A and 9B are an isometric view and a sectional view, respectively, of the enhanced claw shown in FIGS. 8A-8D, in accordance with embodiments of the current invention.
Figure 9B:
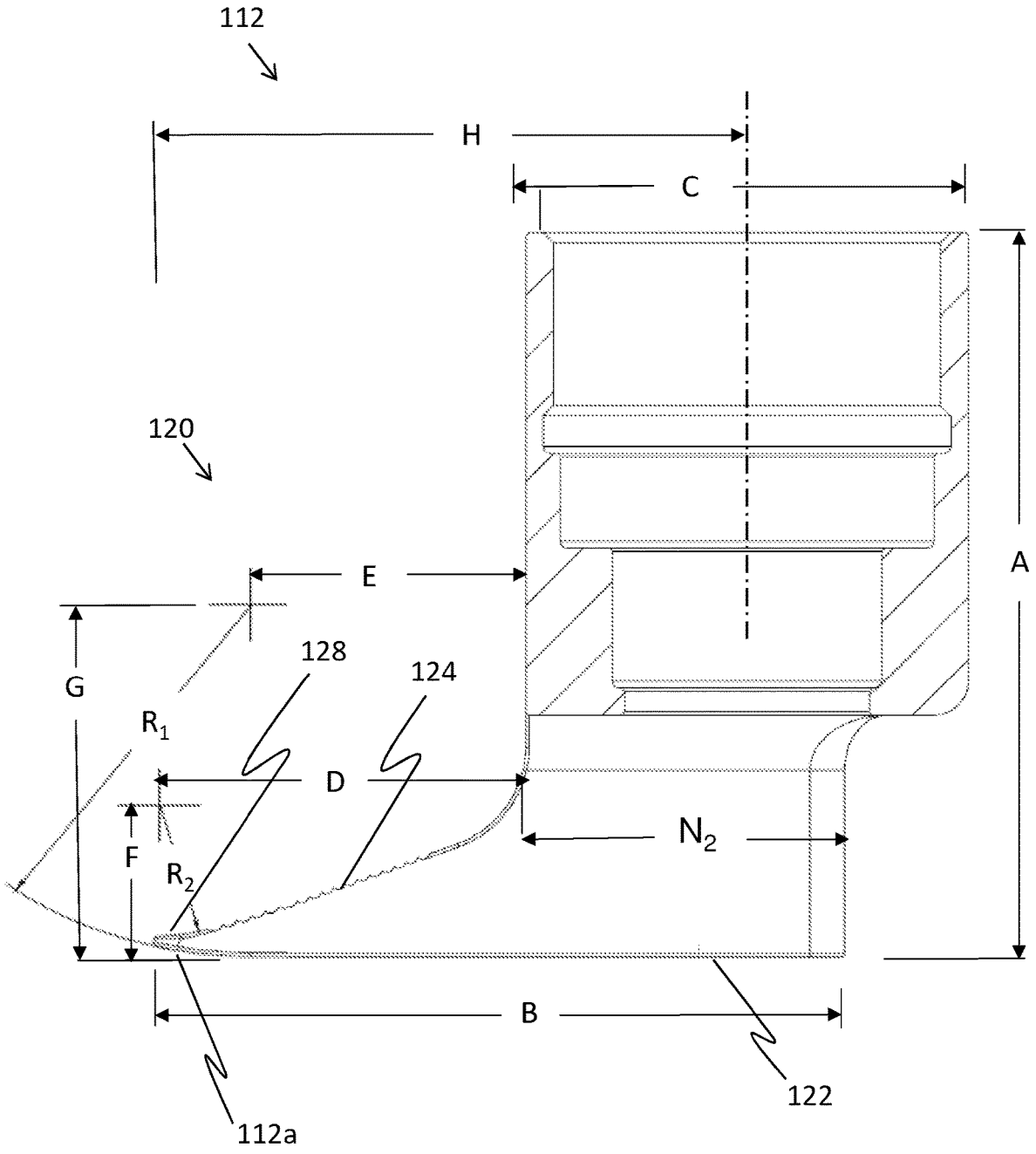

Reference is currently made to FIGS. 9A and 9B, which are an isometric view and a sectional view, respectively, of the enhanced claw shown in FIGS. 8A-8D, in accordance with embodiments of the current invention. Apart from differences described below, enhanced claw 112 and individual teeth 120 of FIGS. 8A to 8D (hereinabove) are identical in notation, configuration, and functionality to that shown in FIGS. 9A and 9B, and elements indicated by the same reference numerals and/or letters are generally identical in configuration, operation, and functionality as described hereinabove.

A neck dimension is indicated by $N_2$. Additional characteristic dimensions of individual teeth 120 are indicated in FIG. 9B by the letters: A, (height of the enhanced claw), B (length of the flat base, including a fillet shown in the figure), C (outer diameter of a socket of the enhanced claw in which the hydraulic cylinder is fitted), D, E, F, G (with D, E, F, and G representing respective coordinate dimensions for the two radii), and by the two radii indicated as $R_1$ and $R_2$. The table which follows indicates approximate exemplary values for the characteristic dimensions and radii, as noted hereinabove.

Exemplary approximate values of characteristic dimensions

| Characteristic dimension | Exemplary approx. dimension (mm) | Approx. variations +/− on dimensions (mm) |
|---|---|---|
| A | 105 | +25/−65 |
| B | 98 | +20/−28 |
| C | 64 | +20/−30 |
| D | 51 | +20/−26 |
| E | 40 | +15/−25 |
| F | 21 | +29/−15 |
| G | 49 | +31/−34 |
| $N_2$ | 43 | +27/−23 |
| $R_1$ | 48.5 | +15/−31 |
| $R_2$ | 18.1 | +44/−19 |

It is emphasized that values listed above serve only as examples of dimensions of the enhanced claw and that embodiments of the current invention include similar claws having similar configurations and/or relative dimensions, which may be scaled and/or modified, mutatis mutandis.

Parameter definitions were described previously for the prior art claw shown in FIG. 7B. The parameter definitions are reiterated hereinbelow and expressed in terms of similar dimensions/characteristics of enhanced claw 111, as shown in FIG. 9B:

- A "slope", F/B, of the grooved-teeth 124 is defined by the dimensions F and B indicated in the figure. Typical values for F and B are, approximately 21 mm and 98 mm, respectively. Therefore, the slope is approximately 0.21.
- A "relative neck width", gives an indication of the robustness/strength of the tooth against torsion, is defined in the expression "$N_2$/B".
- A "relative tooth length", which gives an indication of the tooth geometry allowing entry into a tight gap, is defined by the distance from the centerline of hydraulic cylinder 116 to the edge of the tooth, indicated by H in the referenced figure, divided by the length of the tooth, B.
- A "grooves per mm" value, yielding a measure of the surface area of the tooth to grasp the door/frame, is defined by the number of grooves per running mm of tooth.

Additionally, radii values $R_1$ and $R_2$, including exemplary respective radius center point dimensions DF and EG (referring to FIG. 9B) have been found to yield optimal curved shapes to curved leading base surface 122*a*, which is a curved extension of flat base 122 and to curved leading lip 128, which is a curved extension of the surface defined by grooved-teeth 124, respectively. The enhanced claw, having both a curved leading base surface 122*a* and a curved leading lip 128 and having two rounded contours 126 allowing the enhanced claw to more optimally address the problems of claw slippage, manipulation, repositioning, and more optimal linear alignment with hydraulic piston—all enumerated hereinabove with regard to the prior art.

Figure 7A:
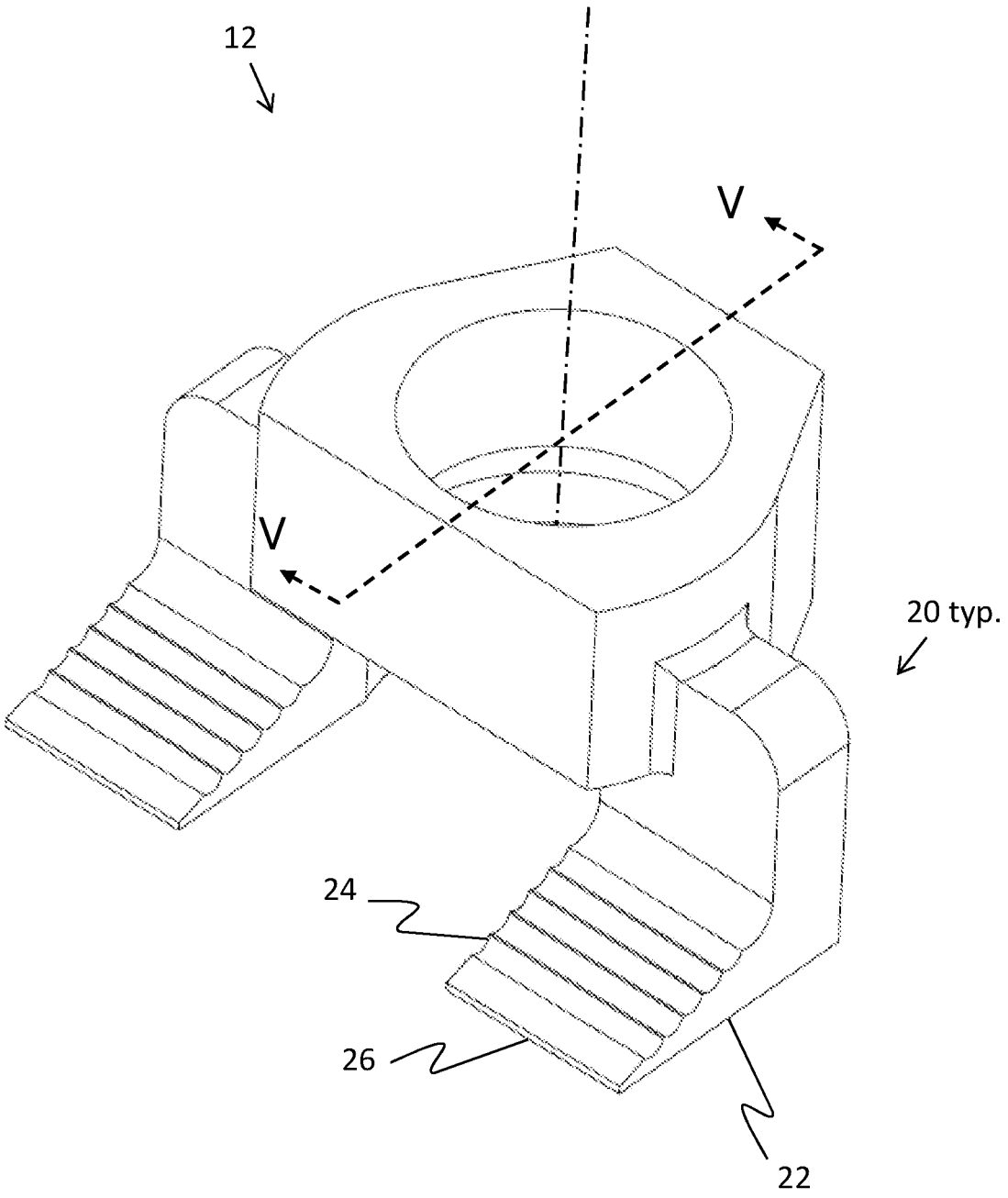
Prior Art FIG 7A
FIGS. 7A and 7B are an isometric view and a cross-sectional view of the prior art static tooth pair shown in FIGS. 3-6.
Figure 7B:
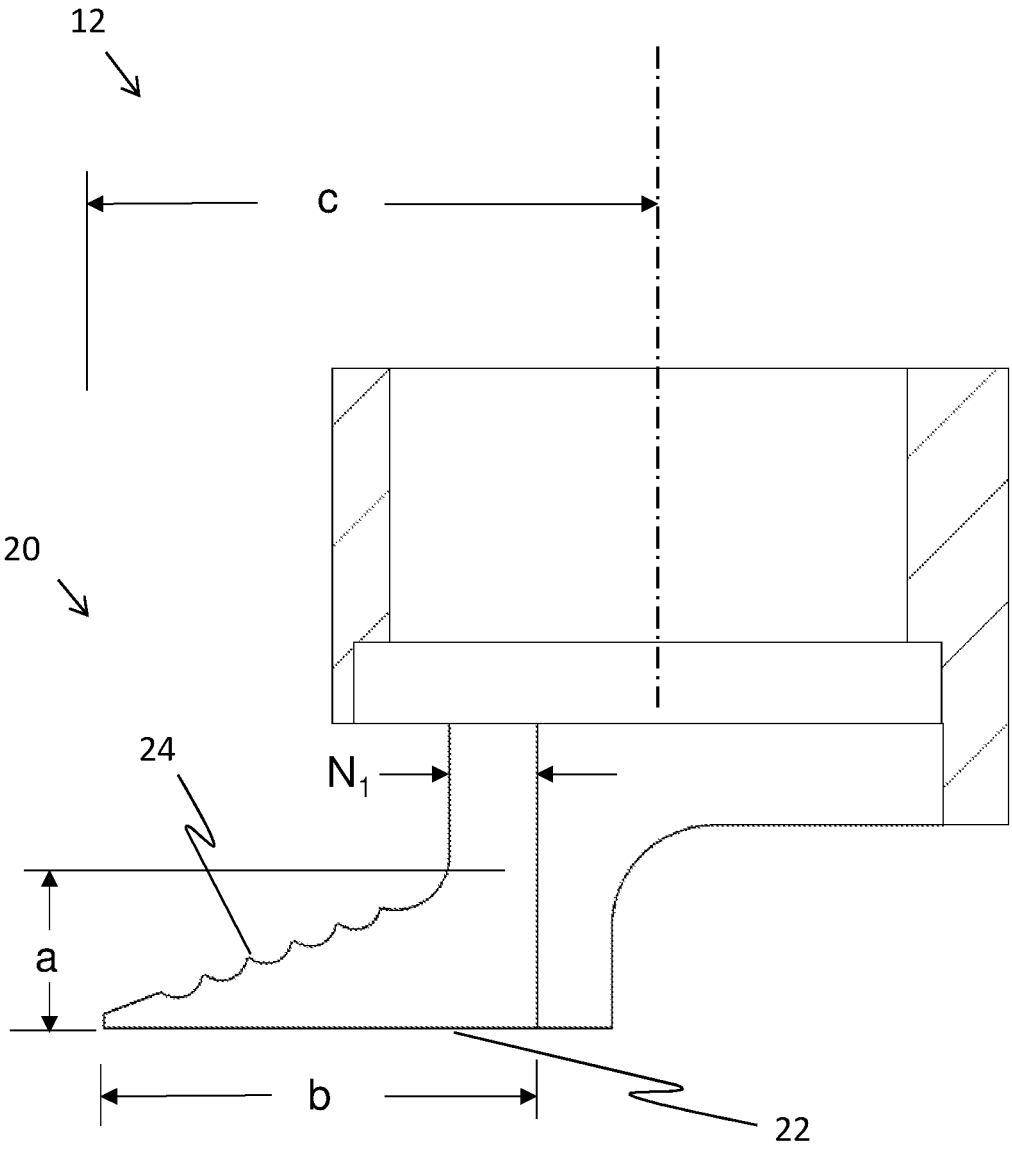
Prior Art FIG 7B

The enhanced claw shown in FIGS. 9A and 9B has a configuration and dimensions significantly different than that of prior art claw 12, shown in FIGS. 7A and 7B. The following table summarizes parameter values of the enhanced claw (using values listed hereinabove) and presents a parametric/characteristic comparison between prior art and enhanced claws.

Parametric/Characteristic comparison between prior art and enhanced claws

| | Prior art Claw (FIG. 7B) | | Enhanced Claw (FIG. 9B) | |
|---|---|---|---|---|
| Parameter | Definition | Value | Definition | Value |
| Slope | a/b | 0.4 | F/B | 0.21 |
| rel. Neck Width | $N_1$/b | 0.2 | $N_2$/B | 0.44 |
| rel. Tooth Length | b/c | 0.93 | B/H | 1.2 |
| Grooves/mm | — | 0.22 | — | 0.89 |
| Radii | none | — | $R_1$, $R_2$ | — |

Summarizing parametric values above, embodiments of the enhanced claw have:

Slope <0.25;

Relative neck Width >0.25; and preferably over 0.4

Relative tooth Length >1.0; and

Grooves/mm >0.3; and preferably over 0.75.

The enhanced claw has radii values $R_1$ and $R_2$—and resultant benefits for breaching—as described hereinabove.

As noted hereinabove, with regard to solving the need not addressed by the prior art, the enhanced claw, in embodiments of the current invention, can be used to effectively and quickly address an array of breaching possibilities without the need for additional tools—thereby allowing rescuers greater ease of deployment and greater speed by carrying as few tools as possible, inter alia. The discussion which follows serve to further illustrate benefits of using the enhanced claw.

Figure 10:
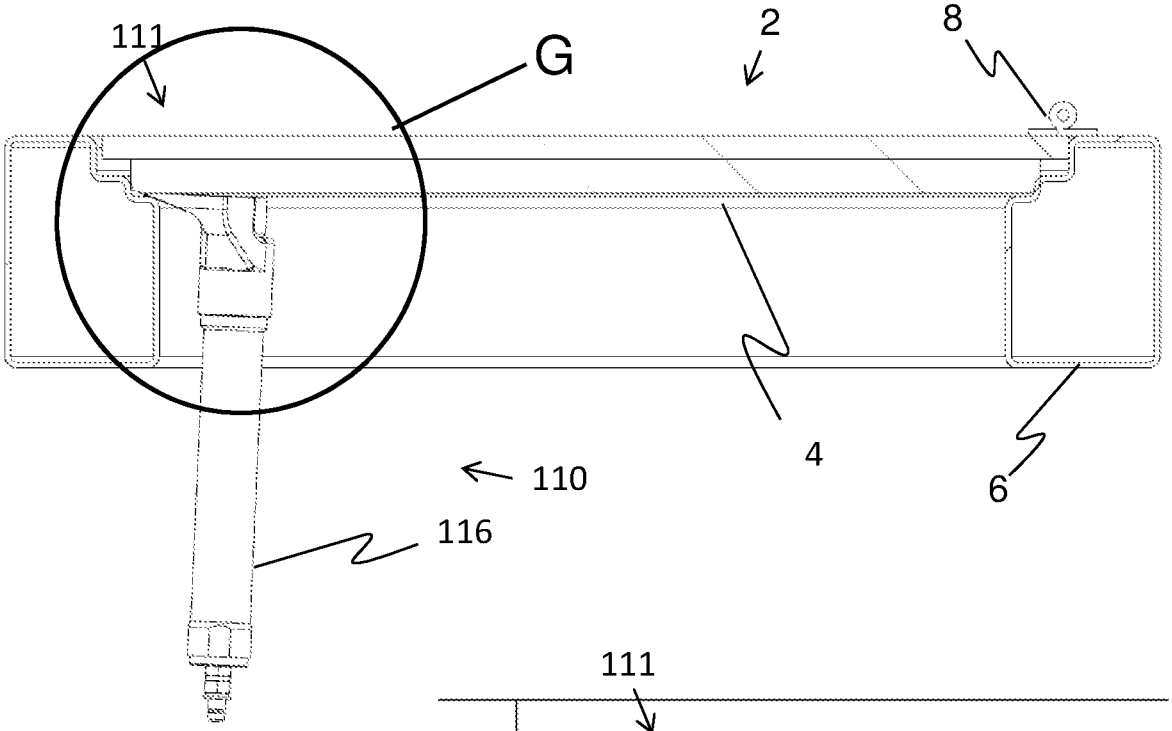
FIG. 10 is a cross-sectional view of the door system, the door, and the enhanced tactical breaching system, in accordance with embodiments of the current invention.
Figure 10:
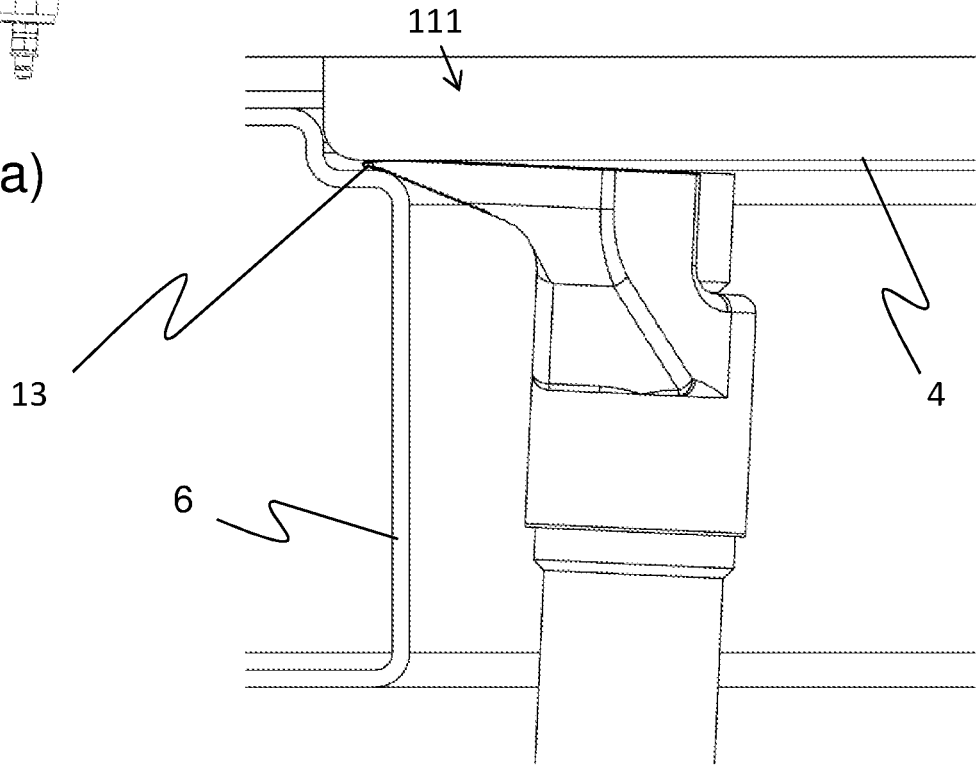

Reference is currently made to FIG. 10, which a cross-sectional view of door system 2, inward opening door 4, and enhanced tactical breaching system 110, in accordance with embodiments of the current invention. Apart from differences described below, tactical breaching system 110 and enhanced claw 112, inter alia, of FIGS. 8A-8D and of FIGS. 9A and 9B (hereinabove) are identical in notation, configuration, and functionality to that shown in FIG. 10, and elements indicated by the same reference numerals and/or letters are generally identical in configuration, operation, and functionality as described hereinabove. FIG. 10 is similar to FIG. 3, where the prior art claw was used to attempt to breach the door.

FIG. 10 serves to illustrate the steps of how enhanced claw 111 is initially used as a crowbar or a similar tool, as known in the art, in breaching inward opening door 4

1. Slide enhanced claw 11, in a closed configuration, into gap 13, taking advantage of the initial sharply-tapered and curved profile described hereinabove;
2. Use a rocking motion to further penetrate the enhanced claw into the gap, the motion similar to that used when working with a crowbar;
3. Open/widen the gap by alternately opening and closing enhanced claw 111 (by operating hydraulic cylinder 116 and drive piston 119) to more substantially penetrate/insert the enhanced claw into and to further open gap 13, taking advantage of the opposing sets of grooved teeth of the static tooth pair and dynamic tooth and of the curved profile of the enhanced claw, previously described, to better insert and lock the grip of the enhanced claw between the door and the frame and thereby direct most of the drive piston energy to breaching the door; and
4. More fully operating the piston to further open the enhanced claw and thereby further breach the door, once step 3 (opening the gap) is completed and the enhanced claw is more substantially penetrated into the gap and locked into position.
5. During breaching, momentarily, partially retracting the piston to remove/reposition the enhanced claw as necessary. Then return to step 4, as necessary.

Figure 11:
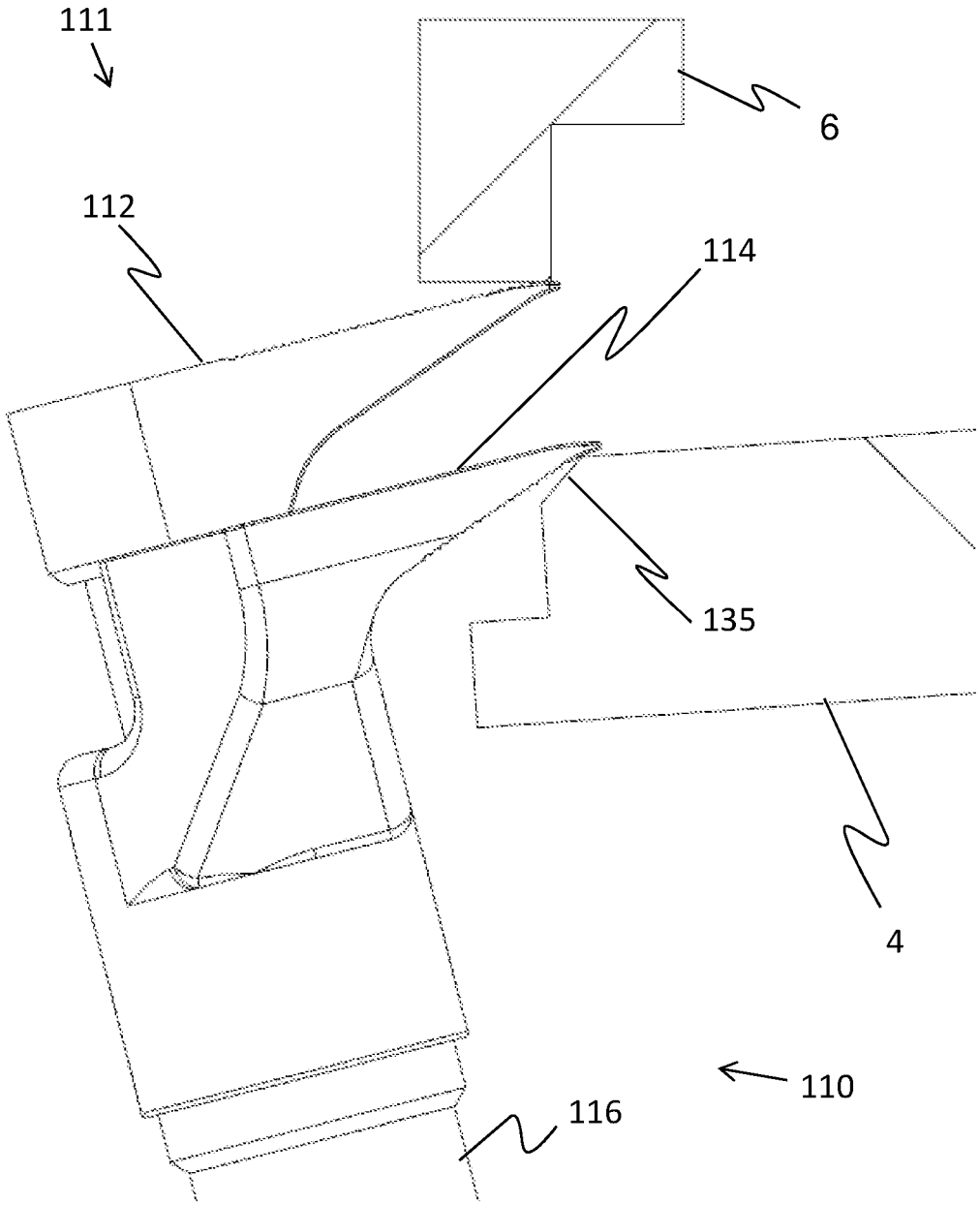
FIGS. 11 and 12 are cross-sectional detailed views of the outward opening door, the frame, and the enhanced tactical breaching system, in accordance with embodiments of the current invention.

Reference is currently made to FIG. 11, which is a cross-sectional detailed view of outward opening door 4, frame 6, and enhanced tactical breaching system 110, in accordance with embodiments of the current invention. Apart from differences described below, tactical breaching system 110 and enhanced claw 111, inter alia, of FIGS. 8A-8D and of FIGS. 9A, 9B, and 10 (hereinabove) are identical in notation, configuration, and functionality to that shown in FIG. 11, and elements indicated by the same reference numerals and/or letters are generally identical in configuration, operation, and functionality as described hereinabove.

The referenced figure, while showing a somewhat different door/frame configuration than shown in FIG. 10, serves to illustrate the end of step 3 and then steps 4 described hereinabove. Specifically, in the referenced figure, the enhanced claw has already been partially opened, as manifested by the separation of static tooth pair 114 and dynamic tooth 112 and by the opposing sets of grooved teeth of the static tooth pair and dynamic tooth that serve to grip and lock the enhanced claw in place. Insertion of the enhanced claw, followed by operation of hydraulic cylinder 116 and drive piston 119, as noted hereinabove, typically yield a deformation 135 of the door as schematically indicated in the figure. The deformation typically serves to better seat the enhanced claw. In some cases, additional rocking motion of enhanced claw 111 (similar to that when using a crowbar, as noted above in step 2) serves to further penetrate the enhanced claw into the gap and to the inside surface of door 2 (thereby better seating the enhanced claw against the door)—and to significantly shorten the time to breach the door and/or avoid complications during breaching, all as noted hereinabove with regard to the prior art.

Finally, and most significantly, the curved profiles of both the static tooth pair and dynamic tooth are visible in the referenced figure, the curved profiles enabling the drive piston to apply force to breach the door in a more optimal, linear configuration while doing so according to the radial opening of the door.

Figure 12:
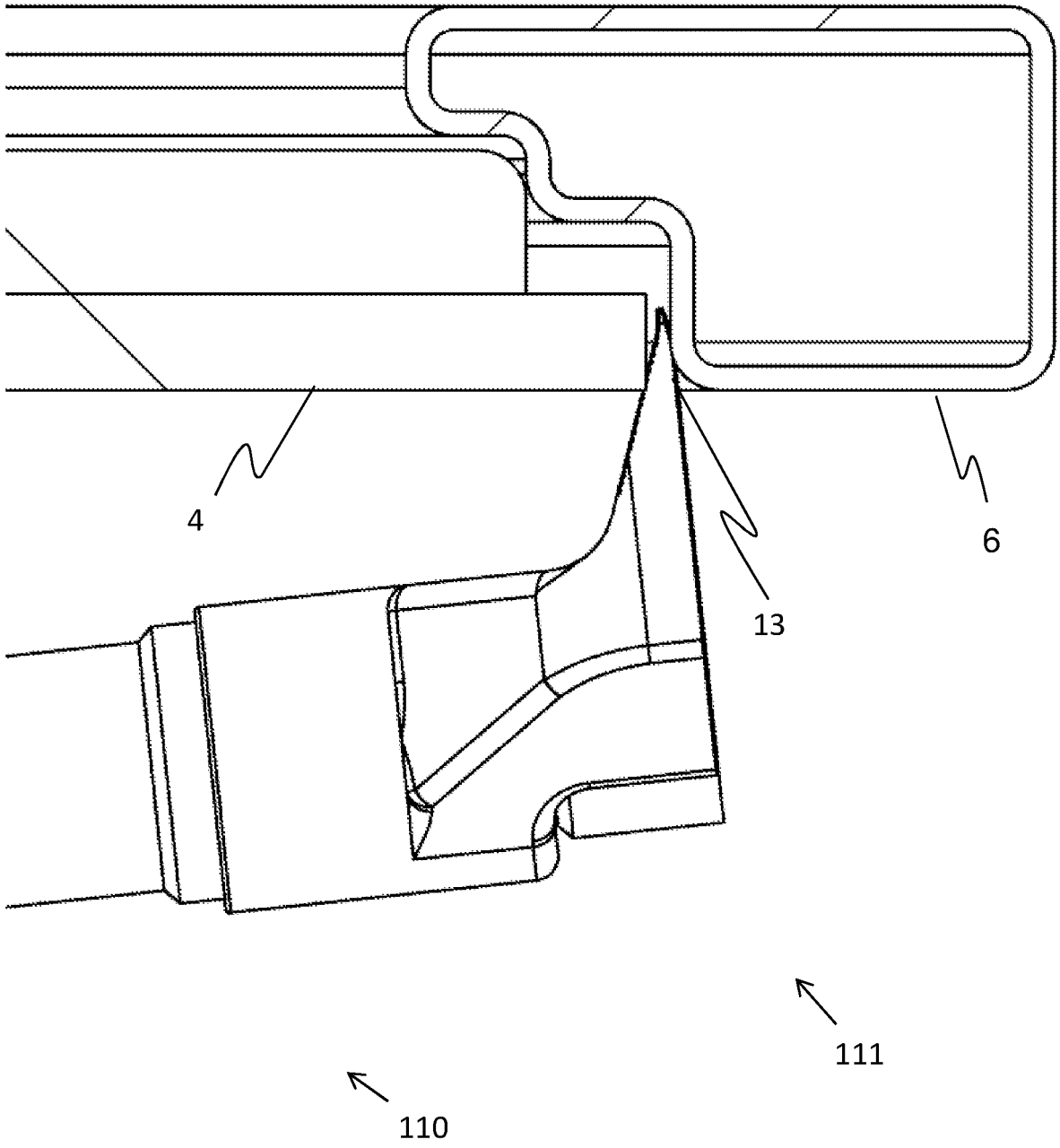

Reference is currently made to FIG. 12, which is a cross-sectional detailed view of outward opening door 4, frame 6 and enhanced tactical breaching system 110, in accordance with embodiments of the current invention. Apart from differences described below, tactical breaching system 110 and enhanced claw 112, inter alia, of FIGS. 8A-8D and of FIGS. 9A, 9B, 10, and 11 (hereinabove) are identical in notation, configuration, and functionality to that shown in FIG. 12, and elements indicated by the same reference numerals and/or letters are generally identical in configuration, operation, and functionality as described hereinabove.

Figure 1:
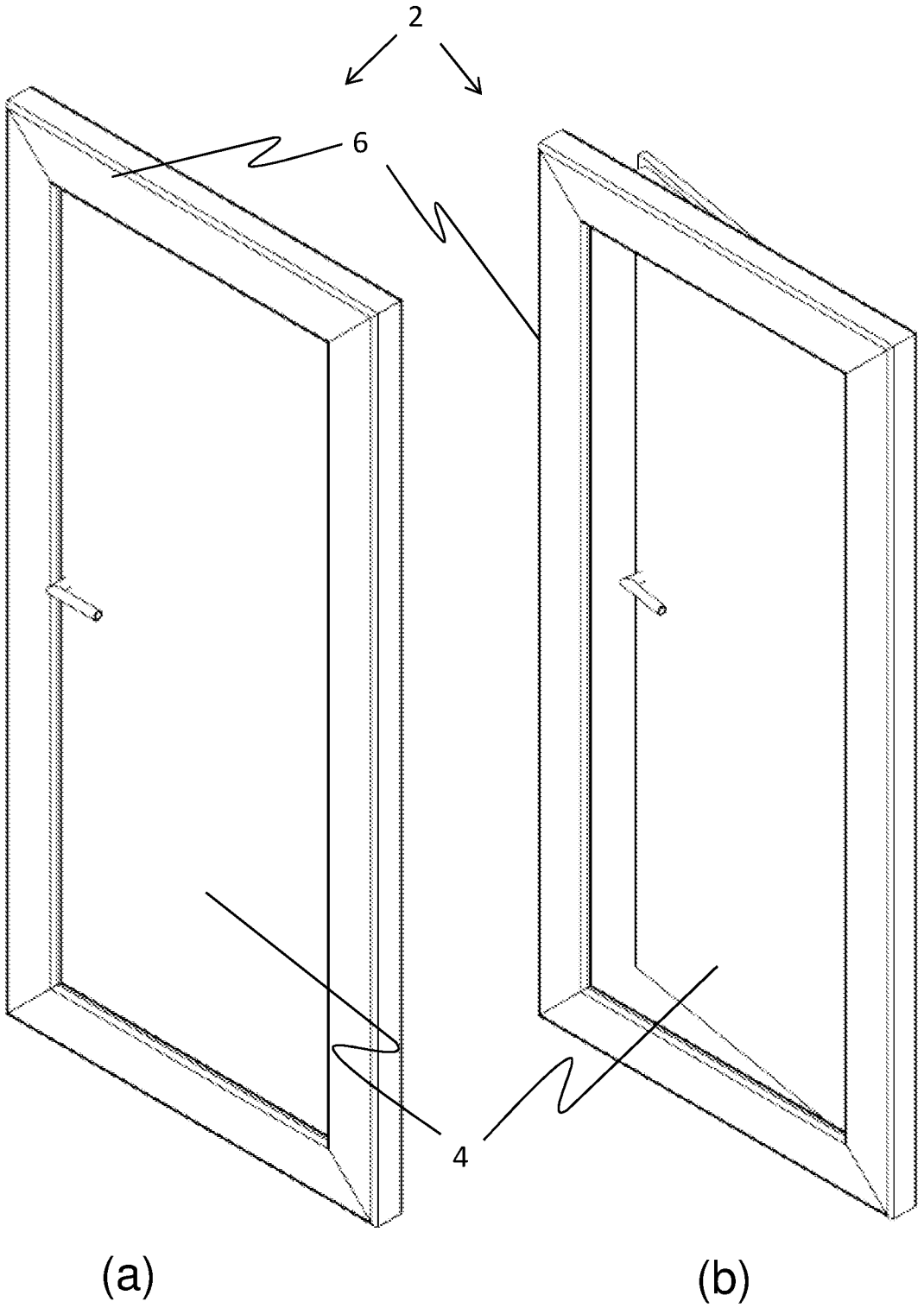
FIGS. 1 and 2 are isometric representations of a prior art door system having a door, a door frame (or simply "frame), and typically two or more door hinges (or simply "hinges")
Figure 2:
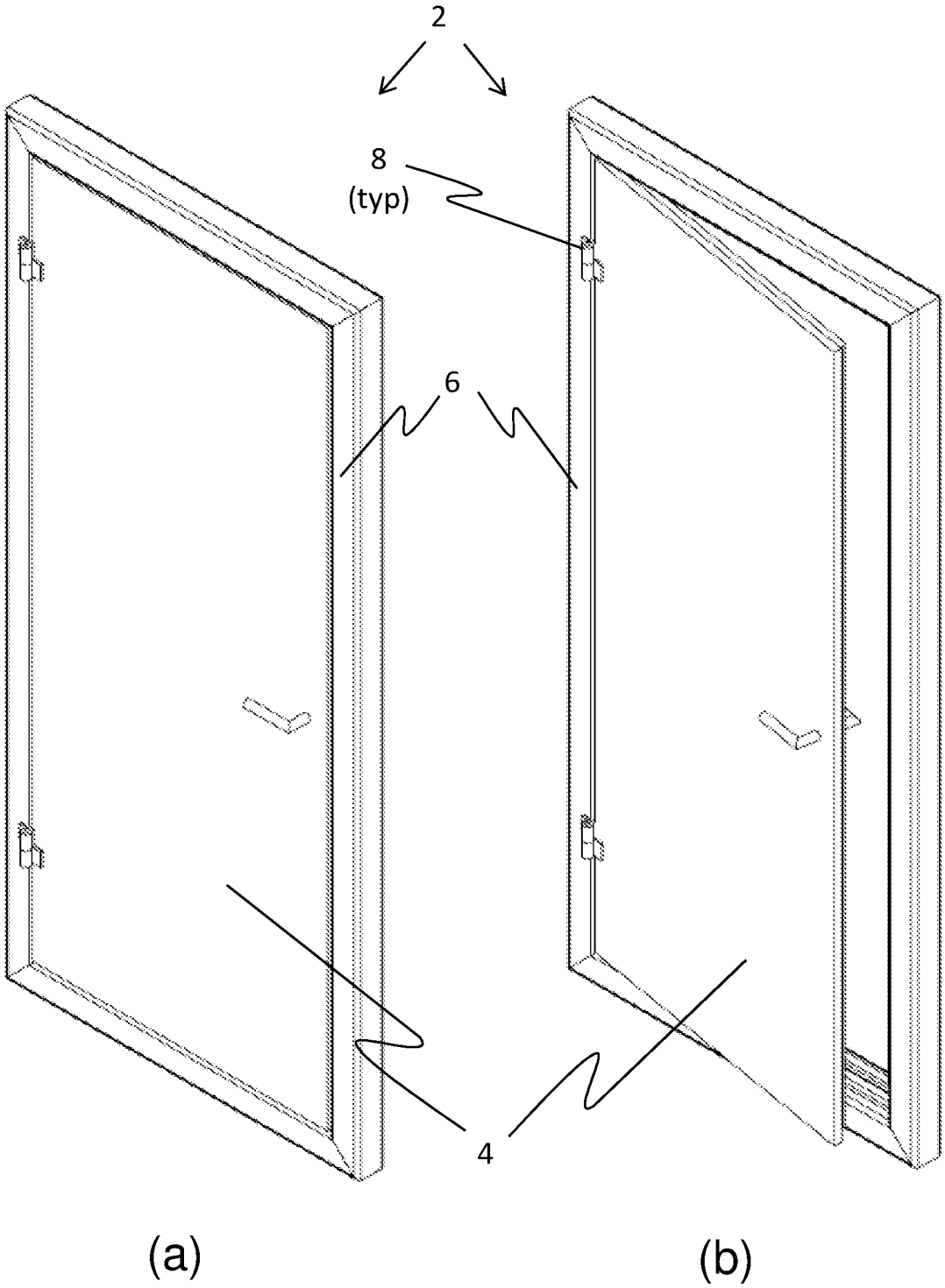
Figure 3:
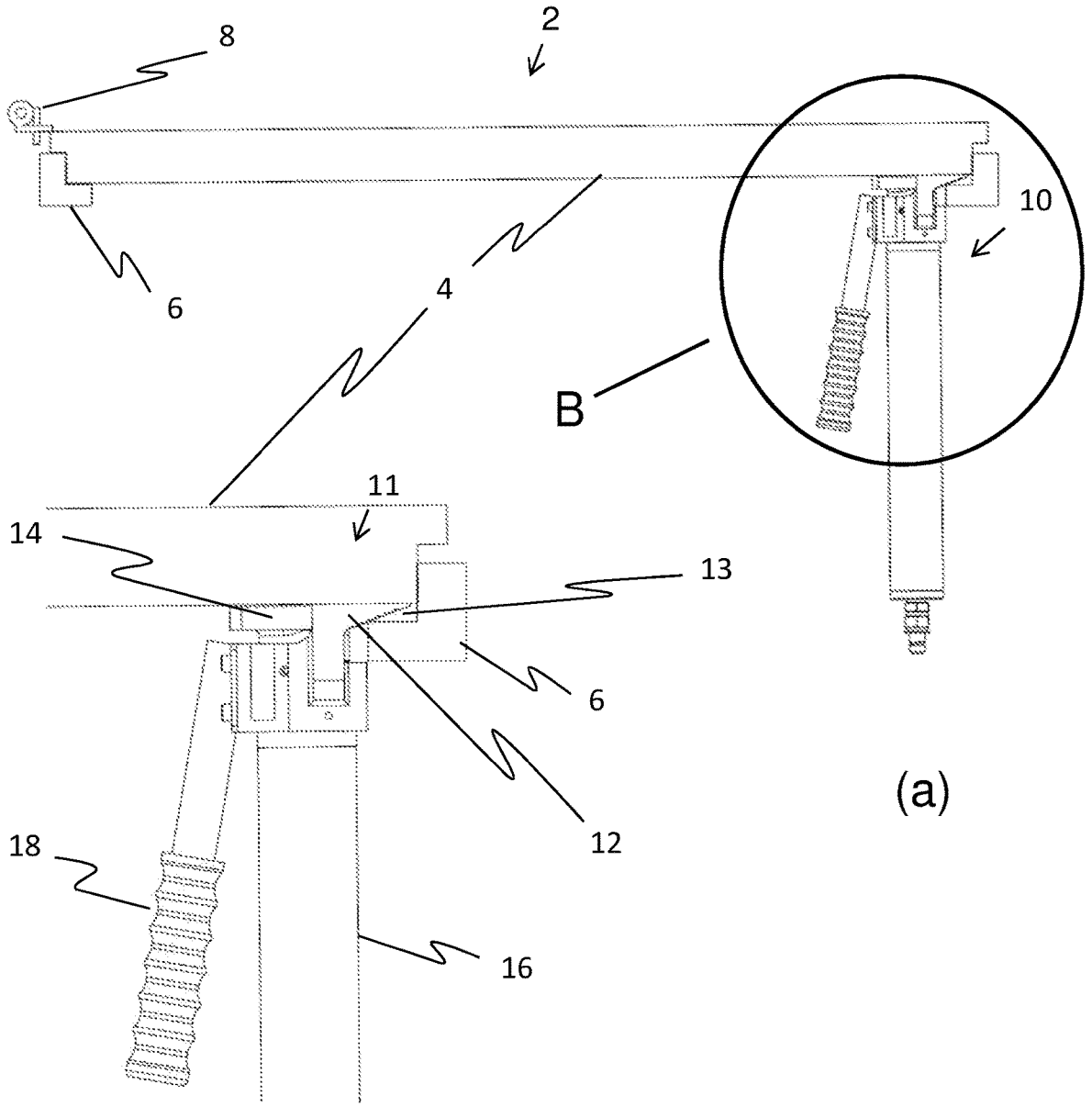
Prior Art FIG 3
FIGS. 3-6 are representations of cross-sectional views of the door system, the door, and the SAN Ltd. prior art tactical breaching system.
Figure 4:
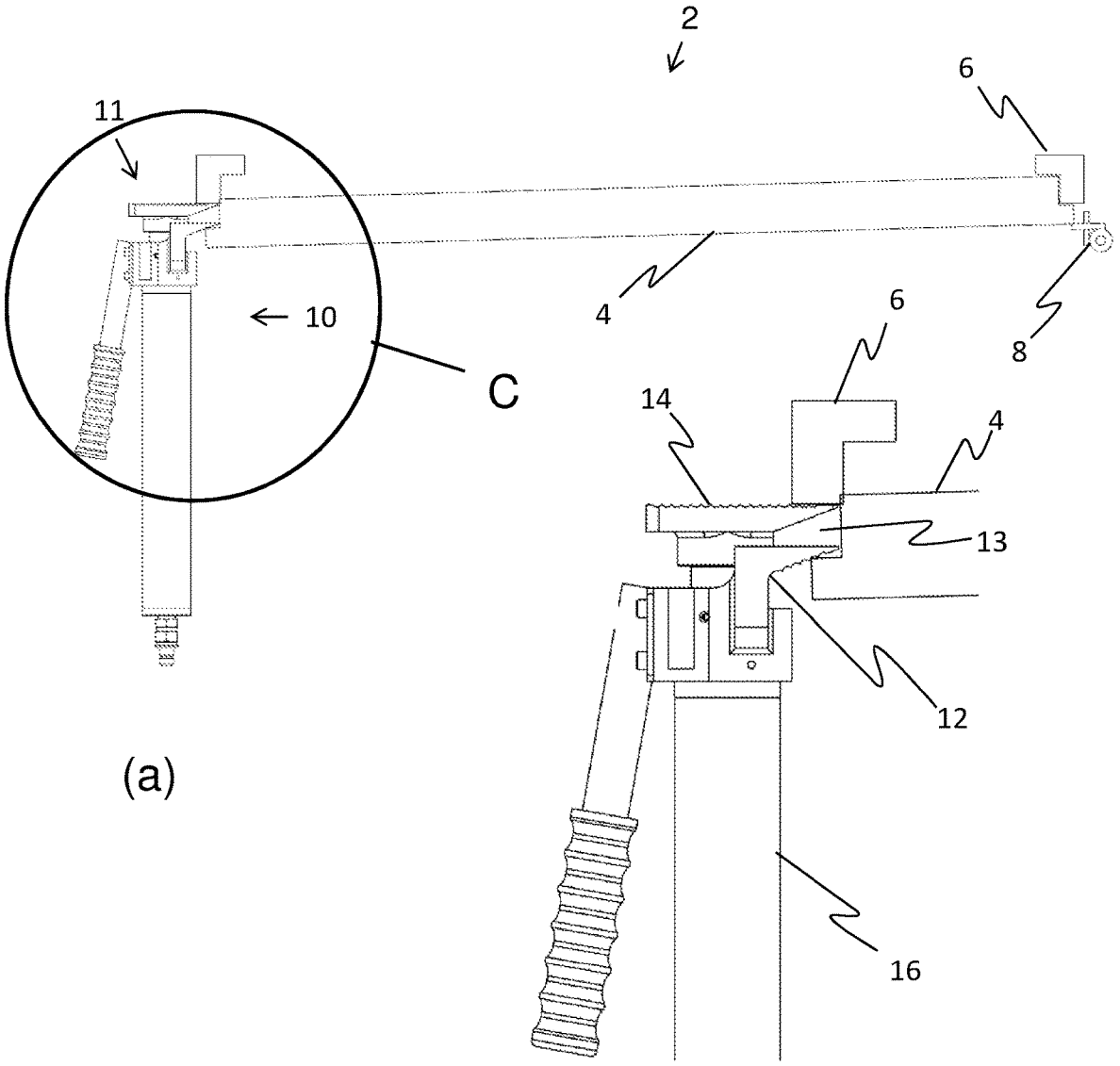
Prior Art FIG 4
Figure 5:
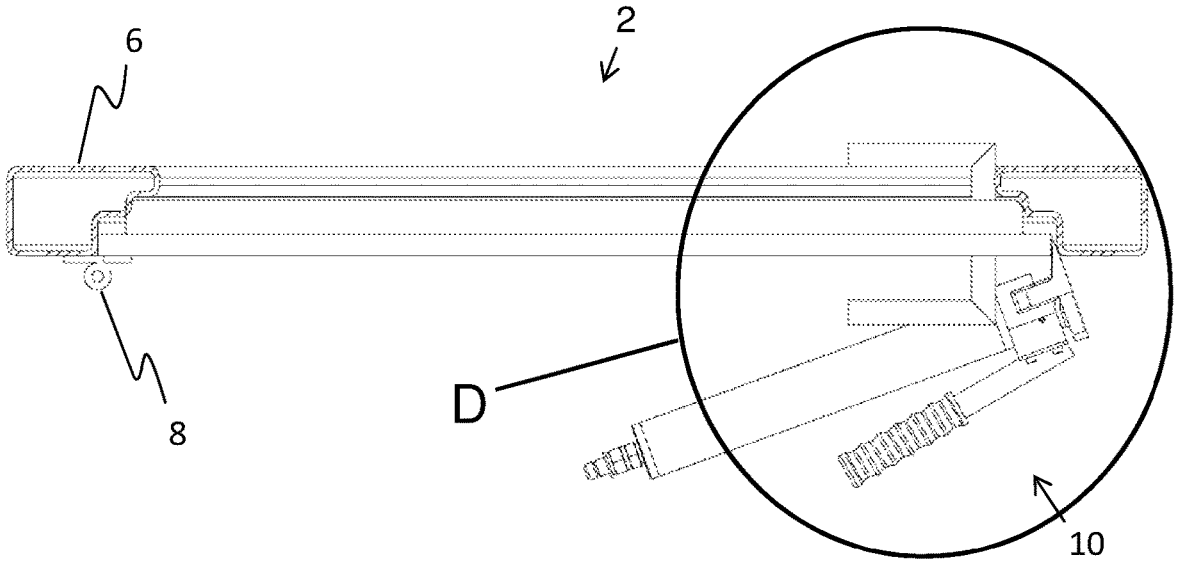
Prior Art FIG 5
Figure 5:
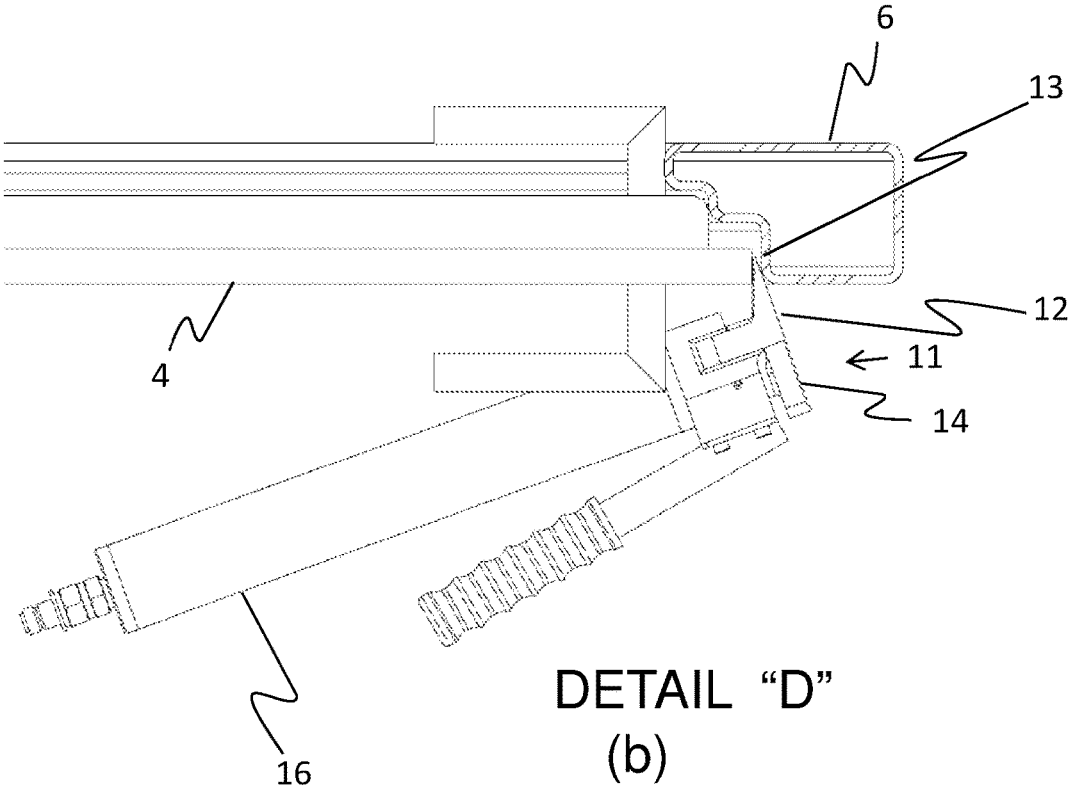
Prior Art FIG 5
Figure 6:
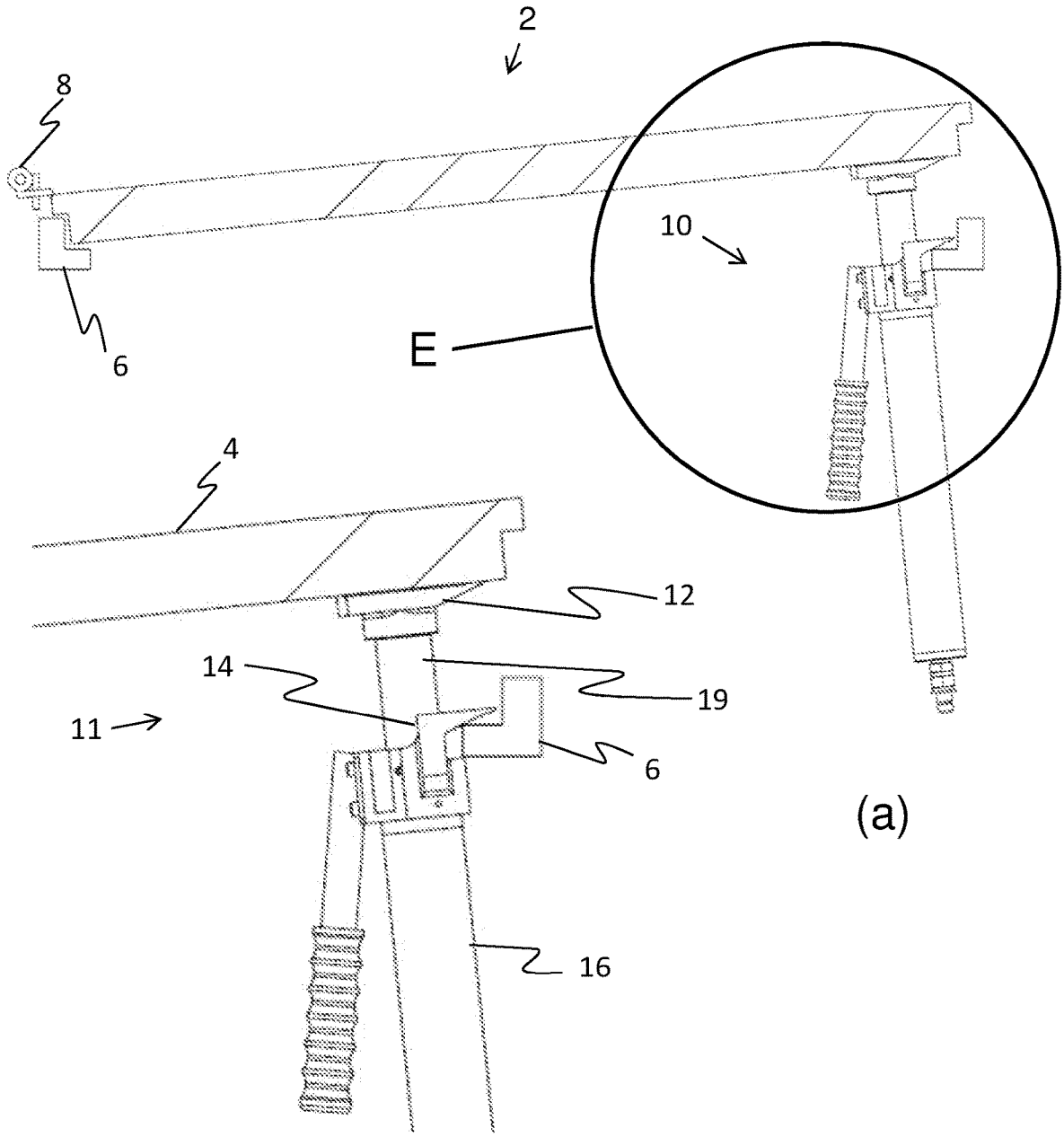
Prior Art FIG 6

The door shown in FIG. 12 has a "zero opening" configuration, where the frame (in this case having a metal and/or reinforced covering) is flush with the door, as known in the art. FIG. 12 is similar to FIG. 5 showing a prior art claw. However, in this configuration, the enhanced claw is inserted in the gap, taking advantage of the enhanced claw's initial sharply-tapered and curved profile—as described in step 1 hereinabove. As the hydraulic cylinder is operated to activate the drive piston to open the enhanced claw, the door is subjected to a crushing force, thereby opening the gap. In parallel, the curved edges of the enhanced claw serve to redirect the angle of the enhanced claw in the gap, and in many cases, to obviate the need for repositioning, as indicted in step 4 hereinabove.

It will be appreciated that the above descriptions are intended only to serve as examples, and that many other embodiments are possible within the scope of the present invention as defined in the appended claims.

The invention claimed is:

1. An enhanced claw in a tactical breaching system for breaching a door system, the door system having a door, a door frame, hinges, and a gap between the door and the door frame, the tactical breaching system having a hydraulic cylinder configured to drive a drive piston, the enhanced claw comprising:

a stationary static tooth pair mechanically and axially fixed to the hydraulic cylinder, the static tooth pair having a top and a bottom static tooth surface;

a dynamic tooth axially attached to the drive piston, the dynamic tooth having a top and a bottom dynamic tooth surface, the dynamic tooth configured to be driven forward and away from the static tooth pair, assuming an open configuration when the drive piston is operated;

the static tooth pair and the dynamic tooth initially aligned in a closed configuration, the enhanced claw having a plurality of characteristics and parameters shared by the static tooth pair and the dynamic tooth, including;

a sharply-tapered and curved profile characterized by a slope parameter having a value less than 0.25, and a relative tooth length parameter having a value of at least 1.0;

a robustness of the claw to resist torsion, characterized by a relative neck width parameter having a value of at least 0.4; and opposing sets of parallelly-grooved teeth, on the top static tooth surface and on the bottom dynamic tooth surface, respectively, characterized by a grooves/mm parameter having a value of at least 0.75 grooves/mm;

wherein the static tooth pair and the dynamic tooth each have:

the flat base characterized by a length dimension, "B";

a vertical axis, coaxial to the drive piston and to the static tooth pair and a tooth pair circular socket having an outer diameter dimension "C", wherein C is substantially larger than B/2;

a tooth length "H", measured perpendicularly from the vertical axis to the edge of the curved leading base surface;

a first radius center point, measured parallel to B and perpendicularly to the vertical axis, having a horizontal dimension equal to E plus C/2 and having a vertical dimension of G, measured perpendicularly from the flat base of the tooth pair; and a second radius center point, measured parallel to B and perpendicularly to the vertical axis, having a horizontal dimension equal to D plus C/2 and having a vertical dimension of F, measured perpendicularly from the flat base of the tooth pair;

wherein the static tooth pair and the dynamic tooth extend substantially perpendicular to the vertical axis; and wherein the enhanced claw is configured for an array of breaching configurations of the door system, without the need for additional tools, the tactical breaching system being an enhanced tactical breaching system.

2. The system of claim 1, wherein the set of plurality of characteristics and parameters further comprises two curved shapes, including: a curved leading base surface, which is a curved extension of a flat base of the bottom dynamic tooth surface and of the bottom static tooth surface; and a curved leading lip, which is a curved extension of the surface defined by the grooved-teeth of the top dynamic tooth surface, the two curved shapes characterized by a first radius and a second radius, respectively.

3. The enhanced claw of claim 2, wherein the static tooth pair has two necks, representing thickened ribs of each tooth of the tooth pair, each neck having a characteristic value $N_2$, measured parallel to B.

4. The enhanced claw of claim 3, wherein the grooved teeth on the top static tooth surface are configured according to the slope parameter, the slope parameter equal to F/B.

5. The enhanced claw of claim 4, wherein the relative neck width is equal to $N_2$/B, and the relative tooth length equal to B/H.

6. The enhanced claw of claim 1, wherein static tooth pair and the dynamic tooth are formed of hardened alloyed steel.

7. A method of using the enhanced claw of claim 1 to breach the door, the method including the steps of:

a. sliding the enhanced claw, in a closed configuration, into the gap, using the initial sharply-tapered and curved profile of the static tooth pair and the dynamic tooth;

b. using a rocking motion to further penetrate the enhanced claw into the gap;

c. opening and widening the gap by alternately opening and closing the enhanced claw by operating the hydraulic cylinder and the drive piston to more substantially penetrate the enhanced claw into and to further open the gap, taking advantage of the opposing sets of grooved teeth of the static tooth pair and dynamic tooth and of the curved profile of the enhanced claw to better insert and lock the enhanced claw between the door and the frame;

d. more fully operating the drive piston to further open the enhanced claw and thereby further breach the door, once step "c" is completed and the enhanced claw is more substantially penetrated into the gap and locked into position; and e. momentarily and partially retracting the piston during breaching to remove and reposition the enhanced claw, as necessary, and returning to step "d", as necessary.

8. The method of claim 7, whereby the array of breaching configurations is addressed without the need for a crowbar and additional tools.

9. The method of claim 8, whereby the curved profile of the static tooth pair and the dynamic tooth enable the drive piston to apply force to breach the door in an optimal, linear configuration while doing so according to the radial opening of the door.

10. The method of claim 9, whereby in the end of step c and in step d, the enhanced claw forms a deformation of the door, whereby a rocking motion is used to further penetrate the enhanced claw into the gap and to the inside surface of the door, thereby better seating the enhanced claw against the door and to significantly shorten the time to breach the door and avoid complications during breaching.

* * * * *